US009518788B2

(12) United States Patent
Jindou et al.

(10) Patent No.: US 9,518,788 B2
(45) Date of Patent: Dec. 13, 2016

(54) HEAT EXCHANGER

(71) Applicant: DAIKIN INDUSTRIES, LTD., Osaka-shi, Osaka (JP)

(72) Inventors: Masanori Jindou, Osaka (JP); Yoshio Oritani, Osaka (JP); Takuya Kazusa, Osaka (JP); Junichi Hamadate, Osaka (JP); Yasutaka Ohtani, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 0 days.

(21) Appl. No.: 14/892,962

(22) PCT Filed: May 20, 2014

(86) PCT No.: PCT/JP2014/002652

§ 371 (c)(1),
(2) Date: Nov. 20, 2015

(87) PCT Pub. No.: WO2014/188714

PCT Pub. Date: Nov. 27, 2014

(65) Prior Publication Data

US 2016/0169596 A1 Jun. 16, 2016

(30) Foreign Application Priority Data

May 22, 2013 (JP) ..... 2013-108356

(51) Int. Cl.
*F28F 9/22* (2006.01)
*F25B 39/02* (2006.01)
(Continued)

(52) U.S. Cl.
CPC ..... *F28F 9/0273* (2013.01); *F25B 39/00* (2013.01); *F25B 39/028* (2013.01);
(Continued)

(58) Field of Classification Search
CPC .... F28F 9/0204; F28F 9/0207; F28D 1/05391; F28D 1/05341; F25B 39/028; F25B 39/04
(Continued)

(56) References Cited

U.S. PATENT DOCUMENTS 2,044,455 A * 6/1936 Witzel ..... F25B 39/02 165/174
5,203,407 A 4/1993 Nagasaka
(Continued)

FOREIGN PATENT DOCUMENTS

JP 2-62282 U 5/1990
JP 4-174297 A 6/1992
(Continued)

*Primary Examiner* — Leonard R Leo
(74) *Attorney, Agent, or Firm* — Birch, Stewart, Kolasch & Birch, LLP

(57) ABSTRACT

A first header collecting pipe of an outdoor heat exchanger has three communication chambers and one mixing chamber. One auxiliary horizontal partition plate is disposed between two main horizontal partition plates. The mixing chamber is defined between the first main horizontal partition plate and the auxiliary horizontal partition plate. A gas-liquid two-phase refrigerant supplied to the outdoor heat exchanger functioning as an evaporator flows into the mixing chamber, and is then distributed to the three communication chambers. This structure allows the refrigerant that is to be distributed from the mixing chamber to the communication chambers to have a uniform wetness.

18 Claims, 13 Drawing Sheets

(51) Int. Cl.

| | |
|---|---|
| ***F28F 9/02*** | (2006.01) |
| ***F28D 1/053*** | (2006.01) |
| ***F25B 39/00*** | (2006.01) |
| ***F28F 1/04*** | (2006.01) |
| ***F28F 1/32*** | (2006.01) |
| *F25B 13/00* | (2006.01) |
| *F28D 1/04* | (2006.01) |

(52) U.S. Cl.
CPC ..... *F28D 1/05325* (2013.01); *F28F 1/04* (2013.01); *F28F 1/325* (2013.01); *F28F 9/0202* (2013.01); *F28F 9/0212* (2013.01); *F25B 13/00* (2013.01); *F28D 1/0417* (2013.01); *F28F 9/0204* (2013.01); *F28F 9/028* (2013.01); *F28F 9/0278* (2013.01)

(58) Field of Classification Search
USPC ..... 165/174, 176, 110; 62/525
See application file for complete search history.

(56) References Cited

U.S. PATENT DOCUMENTS

| | | | | |
|---|---|---|---|---|
| 5,901,785 | A | 5/1999 | Chiba et al. | |
| 7,484,555 | B2 * | 2/2009 | Beamer et al. | F28D 1/05375 165/174 |
| 7,819,177 | B2 * | 10/2010 | Beamer et al. | F28D 1/05375 165/174 |
| 2010/0089095 | A1 * | 4/2010 | Macri et al. | F25B 39/028 62/525 |

FOREIGN PATENT DOCUMENTS

| | | | | |
|---|---|---|---|---|
| JP | 6-74609 | A | 3/1994 | |
| JP | 9-264693 | A | 10/1997 | |
| JP | 10-267467 | A | 10/1998 | |
| JP | 2013-83419 | A | 5/2013 | |
| JP | WO 2013076993 | A1 * | 5/2013 | F28D 1/05391 |

* cited by examiner

B-B CROSS SECTION

R-R CROSS SECTION

S-S CROSS SECTION

T-T CROSS SECTION

V-V CROSS SECTION

Y-Y CROSS SECTION

W-W CROSS SECTION

Z-Z CROSS SECTION

X-X CROSS SECTION

HEAT EXCHANGER

TECHNICAL FIELD

The present invention relates to a heat exchanger which includes a pair of header collecting pipes and a plurality of flat tubes connected to the header collecting pipes so that heat is exchanged between a refrigerant flowing inside the flat tubes and air.

BACKGROUND ART

Heat exchangers have been known which include a multitude of flat tubes and a header collecting pipe connected to the flat tubes, and in which heat is exchanged between a refrigerant flowing inside the flat tubes and air flowing outside the flat tubes. In the heat exchanger disclosed in Patent Document 1, a multitude of vertically-extending flat tubes are arranged in the horizontal direction, and a header collecting pipe is connected to respective lower ends of the flat tubes. Further, in the heat exchanger disclosed in Patent Document 2, a multitude of horizontally-extending flat tubes are arranged in the vertical direction, and a header collecting pipe is connected to respective end portions of the flat tubes.

A refrigerant supplied to the heat exchanger of this type first flows into the header collecting pipe, and then branches into multiple flows to go into the plurality of flat tubes. When the heat exchanger of this type functions as an evaporator for a refrigerating apparatus, a gas-liquid two-phase refrigerant is supplied to the heat exchanger. That is, in this case, a gas-liquid two-phase refrigerant is distributed to the respective flat tubes through the header collecting pipe.

CITATION LIST

Patent Document

Patent Document 1: Japanese Unexamined Patent Publication No. H09-264693

Patent Document 2: Japanese Unexamined Patent Publication No. H06-074609

SUMMARY OF THE INVENTION

Technical Problem

It is preferred that the gas-liquid two-phase refrigerant be distributed to a plurality of flat tubes, with the refrigerant flowing into the respective flat tubes having as uniform wetness as possible. To ensure a uniform wetness of the refrigerant flowing into the respective flat tubes, it is preferred that the gas-liquid two-phase refrigerant which has flowed into the header collecting pipe be homogenized as much as possible before being supplied into the respective flat tubes. As a method for doing that, the gas-liquid two-phase refrigerant may be guided into a chamber formed in the header collecting pipe and stirred before being distributed to the respective flat tubes. However, such a structure of a header collecting pipe that has a chamber into which a gas-liquid two-phase refrigerant flows before being distributed to the respective flat tubes has not been studied sufficiently yet.

In view of the foregoing, it is therefore an object of the invention to provide a heat exchanger which includes a pair of header collecting pipes and flat tubes and in which one of the header collecting pipes has a chamber into which a gas-liquid two-phase refrigerant flows before being distributed to the respective flat tubes, in order that the refrigerant to flow into the flat tubes have a uniform wetness.

Solution to the Problem

A first aspect of the invention is directed to a heat exchanger including a plurality of flat tubes (32), a first header collecting pipe (60) to which one end of each of the flat tubes (32) is connected, a second header collecting pipe (70) to which the other end of each of the flat tubes (32) is connected, and a plurality of fins (36) joined to the flat tubes (32). The heat exchanger is capable of functioning as an evaporator by exchanging heat between a refrigerant flowing in the flat tubes (32) and air. The first header collecting pipe (60) and the second header collecting pipe (70) stand upright, and the first header collecting pipe (60) is provided with one connection port (66) to which a pipe is connected to guide a gas-liquid two-phase refrigerant into the first header collecting pipe (60). The first header collecting pipe (60) has main horizontal partition plates (80*a*, 80*b*) that define a plurality of communication chambers (62*a*-62*c*), each communicating with one or more of the flat tubes (32), by horizontally crossing an internal space of the first header collecting pipe (60), a vertical partition plate (90) that defines a mixing chamber (63), communicating with the connection port (66) and all of the communication chambers (62*a*-62*c*), by vertically running through the internal space of the first header collecting pipe (60), and an auxiliary horizontal partition plate (85*a*) that defines, along with the vertical partition plate (90), the mixing chamber (63) by being disposed between the main horizontal partition plates (80*a*, 80*b*), which are vertically adjacent to each other, and by horizontally crossing the internal space of the first header collecting pipe (60).

The first header collecting pipe (60) of the first aspect of the invention has a single mixing chamber (63) and a plurality of communication chambers (62*a*-62*c*). In a state where the heat exchanger (23) of this invention functions as an evaporator, the gas-liquid two-phase refrigerant is supplied to the first header collecting pipe (60). Specifically, the gas-liquid two-phase refrigerant passes through the connection port (66) and flows into the mixing chamber (63), and is then distributed to the plurality of communication chambers (62*a*-62*c*). The gas-liquid two-phase refrigerant which has flowed into the respective communication chambers (62*a*-62*c*) flows in the flat tubes (32) that communicate with the communication chambers (62*a*-62*c*), and then flows in the second header collecting pipe (70). A liquid refrigerant contained in the gas-liquid two-phase refrigerant absorbs heat from air while passing through the flat tubes (32), and evaporates either partially or entirely.

The first header collecting pipe (60) of the first aspect of the invention has main horizontal partition plates (80*a*, 80*b*), a vertical partition plate (90), and an auxiliary horizontal partition plate (85*a*). The main horizontal partition plates (80*a*, 80*b*) arranged to horizontally cross the internal space of the first header collecting pipe (60) define the plurality of communication chambers (62*a*-62*c*). On the other hand, the vertical partition plate (90) arranged to vertically run through the internal space of the first header collecting pipe (60), and the auxiliary horizontal partition plate (85*a*) arranged to horizontally cross the internal space of the first header collecting pipe (60) define the mixing chamber (63).

According to the first aspect of the invention, the auxiliary horizontal partition plate (85*a*) is disposed between the main horizontal partition plates (80*a*, 80*b*) which are vertically adjacent to each other. If the mixing chamber (63) were defined by the vertical partition plate (90) and the main horizontal partition plates (80*a*, 80*b*), the height of the mixing chamber (63) would be the same as the interval between the main horizontal partition plates (80*a*, 80*b*). On the other hand, according to the first aspect of the invention, the mixing chamber (63) is defined by the vertical partition plate (90) and the auxiliary horizontal partition plate (85*a*). This configuration allows for setting the height of the mixing chamber (63), irrespective of the interval between the main horizontal partition plates (80*a*, 80*b*).

A second aspect of the invention is an embodiment of the first aspect of the invention. In the second aspect, the mixing chamber (63) is shorter in height than the communication chamber (62*b*) adjacent to the mixing chamber (63) with the vertical partition plate (90) interposed between the two chambers (63, 62*b*).

According to the second aspect of the invention, the mixing chamber (63) is shorter in height than the communication chamber (62*b*) adjacent to the mixing chamber (63) with the vertical partition plate (90) interposed between the two chambers (63, 62*b*). That is, according to this aspect of the invention, the height of the mixing chamber (63) is shorter than the interval between the main horizontal partition plates (80*a*, 80*b*) which define the communication chamber (62*b*).

A third aspect of the invention is an embodiment of the first or second aspect of the invention. In the third aspect, the vertical partition plate (90) is arranged opposite the flat tubes (32) with respect to a central axis (64) of the first header collecting pipe (60).

According to the third aspect of the invention, the vertical partition plate (90) which defines the mixing chamber (63) is arranged opposite the flat tubes (32) with respect to the central axis (64) of the first header collecting pipe (60). Thus, the width of the mixing chamber (63) as measured orthogonally to the central axis (64) of the first header collecting pipe (60) is less than half the internal diameter of the first header collecting pipe (60).

A fourth aspect of the invention is an embodiment of any one of the first to third aspects of the invention. In the fourth aspect, the mixing chamber (63) is separated from the communication chambers (62*a*-62*c*) by the vertical partition plate (90), one of the main horizontal partition plates (80*a*) which is arranged on one side of (that is either over or under) the mixing chamber (63), and the auxiliary horizontal partition plate (85*a*) arranged on the other side of (that is either under or over) the mixing chamber (63).

According to the fourth aspect of the invention, the mixing chamber (63) is separated from the communication chambers (62*a*-62*c*) by the vertical partition plate (90), one of the main horizontal partition plates (80*a*), and one auxiliary horizontal partition plate (85*a*). The main horizontal partition plate (80*a*) and the auxiliary horizontal partition plate (85*a*) which separate the mixing chamber (63) from the communication chambers (62*a*-62*c*) are arranged such that one of the two plates (80*a*, 85*a*) is disposed over the mixing chamber (63) and the other is disposed under the mixing chamber (63).

A fifth aspect of the invention is an embodiment of the fourth embodiment. In the fifth aspect, each of the vertical partition plate (90), main horizontal partition plate (80*a*), and auxiliary horizontal partition plate (85*a*) which separate the mixing chamber (63) from the communication chambers (62*a*-62*c*) is provided with a communication through hole (81*a*, 86*a*, 95) through which the refrigerant in the mixing chamber (63) is distributed to the respective communication chambers (62*a*-62*c*) at a predetermined ratio.

According to the fifth aspect of the invention, each of the vertical partition plate (90), the main horizontal partition plate (80*a*), and the auxiliary horizontal partition plate (85*a*) which separate the mixing chamber (63) from the communication chambers (62*a*-62*c*) is provided with a communication through hole (81*a*, 86*a*, 95). The ratio of the flow rates of the refrigerant which flows in the respective communication chambers (62*a*-62*c*) from the mixing chamber (63) may be set to be a predetermined value by adjusting the sizes of these communication through holes (81*a*, 86*a*, 95).

A sixth aspect of the invention is an embodiment of any one of the first to third aspects of the invention. In the sixth aspect, the mixing chamber (63) is separated from the communication chambers (62*a*-62*d*) by the vertical partition plate (90) and a pair of auxiliary horizontal partition plates (85*a*, 85*b*) arranged one above the other with the mixing chamber (63) interposed between themselves (85*a*, 85*b*).

According to the sixth aspect of the invention, the mixing chamber (63) is separated from the communication chambers (62*a*-62*d*) by the vertical partition plate (90) and a pair of auxiliary horizontal partition plates (85*a*, 85*b*). The auxiliary horizontal partition plates (85*a*, 85*b*) which separate the mixing chamber (63) from the communication chambers (62*a*-62*d*) are arranged one above the other with the mixing chamber (63) interposed between themselves (85*a*, 85*b*).

A seventh aspect of the invention is an embodiment of the sixth aspect of the invention. In the seventh aspect of the invention, each of the pair of auxiliary horizontal partition plates (85*a*, 85*b*) and the vertical partition plate (90) which separate the mixing chamber (63) from the communication chambers (62*a*-62*d*) is provided with a communication through hole (86*a*, 86*b*, 95*a*, 95*b*) through which the refrigerant in the mixing chamber (63) is distributed to the respective communication chambers (62*a*-62*d*) at a predetermined ratio.

According to the seventh aspect of the invention, each of the pair of auxiliary horizontal partition plates (85*a*, 85*b*) and the vertical partition plate (90) which separate the mixing chamber (63) from the communication chambers (62*a*-62*d*) is provided with a communication through hole (86*a*, 86*b*, 95*a*, 95*b*). The ratio of the flow rates of the refrigerant which flows in the respective communication chambers (62*a*-62*d*) from the mixing chamber (63) may be set to be a predetermined value by adjusting the sizes of these communication through holes (86*a*, 86*b*, 95*a*, 95*b*).

An eighth aspect of the invention is an embodiment of any one of the first to third aspects of the invention. In the eighth aspect, the mixing chamber (63) lies next to one or two of the communication chambers (62*b*, 62*c*) with the vertical partition plate (90) interposed between the chambers (63, 62*b*, 62*c*).

According to the eighth aspect of the invention, the mixing chamber (63) lies next to one or two of the communication chambers (62*b*, 62*c*) with the vertical partition plate (90) interposed between the chambers (63, 62*b*, 62*c*).

A ninth aspect of the invention is an embodiment of any one of the first to third aspects of the invention. In the ninth aspect, the vertical partition plate (90) is provided with a communication through hole (95) through which the mixing chamber (63) communicates with the communication chamber (62*b*) which lies next to the mixing chamber (63) with the vertical partition plate (90) interposed between the chambers (62*b*, 63).

According to the ninth aspect of the invention, the vertical partition plate (90) is provided with a communication through hole (95). The refrigerant in the mixing chamber (63) flows through the communication through hole (95) into the communication chamber (62*b*) which lies next to the mixing chamber (63) with the vertical partition plate (90) interposed between the chambers (62*b*, 63).

A tenth aspect of the invention is an embodiment of the ninth aspect of the invention. In the tenth aspect, the connection port (66) is formed in a sidewall of the first header collecting pipe (60) and faces the vertical partition plate (90), and the communication through hole (95) of the vertical partition plate (90) is arranged so as not to face the connection port (66).

According to the tenth aspect of the invention, the connection port (66) formed in the first header collecting pipe (60) faces the vertical partition plate (90). Thus, the gas-liquid two-phase refrigerant which has flowed in the mixing chamber (63) through the connection port (66) collides against the vertical partition plate (90) facing the connection port (66). Further, according to this aspect of the invention, the vertical partition plate (90) is provided with the communication through hole (95) arranged so as not to face the connection port (66). Thus, the refrigerant which has flowed in the mixing chamber (63) from the connection port (66) does not converge toward the communication through hole (95) of the vertical partition plate (90).

An eleventh aspect of the invention is an embodiment of any one of the first to tenth aspects of the invention. In the eleventh aspect, the heat exchanger is divided into a main heat exchange region (51) and an auxiliary heat exchange region (52) which each have at least two of the flat tubes (31, 32). The auxiliary heat exchange region (52) is arranged under the main heat exchange region (51). The auxiliary heat exchange region (52) is divided into a plurality of auxiliary heat exchange portions (52*a*-52*c*), each of which has a plurality of flat tubes (32) and is associated with one of the communication chambers (62*a*-62*c*). The flat tubes (32) of the auxiliary heat exchange portions (52*a*-52*c*) communicate with the communication chambers (62*a*-62*c*) associated with the respective auxiliary heat exchange portions (52*a*-52*c*). The main heat exchange region (51) is divided into a plurality of main heat exchange portions (51*a*-51*c*), each of which has a plurality of flat tubes (31) and is associated with one of the auxiliary heat exchange portions (52*a*-52*c*). The flat tubes (31) of the main heat exchange portions (51*a*-51*c*) communicate, through the second header collecting pipe (70), with the flat tubes (32) of the auxiliary heat exchange portions (52*a*-52*c*) associated with the main heat exchange portions (51*a*-51*c*).

According to the eleventh aspect of the invention, the heat exchanger (23) is divided into the main heat exchange region (51) and the auxiliary heat exchange region (52). Further, the main heat exchange region (51) is divided into a plurality of main heat exchange portions (51*a*-51*c*), and the auxiliary heat exchange region (52) is divided into a plurality of auxiliary heat exchange portions (52*a*-52*c*). There is one-to-one correspondence between the main heat exchange portions (51*a*-51*c*) and the auxiliary heat exchange portions (52*a*-52*c*). In a state where the heat exchanger (23) functions as an evaporator, the gas-liquid two-phase refrigerant flows in the mixing chamber (63) in the first header collecting pipe (60). The refrigerant in the mixing chamber (63) is distributed to the plurality of communication chambers (62*a*-62*c*), and flows in the flat tubes (32) of the auxiliary heat exchange portions (52*a*-52*c*) associated with the communication chambers (62*a*-62*c*). The refrigerant which has passed through the flat tubes (32) of the respective auxiliary heat exchange portions (52*a*-52*c*) passes through the second header collecting pipe (70), and flows in the flat tubes (31) of the corresponding main heat exchange portions (51*a*-51*c*).

Advantages of the Invention

According to the present invention, the main horizontal partition plates (80*a*, 80*b*), the vertical partition plate (90), and the auxiliary horizontal partition plate (85*a*) which are provided in the first header collecting pipe (60) define a single mixing chamber (63) and a plurality of communication chambers (62*a*-62*c*) in the first header collecting pipe (60). In a state where the heat exchanger (23) functions as an evaporator, the wetness of the refrigerant to be distributed to the respective communication chambers (62*a*-62*c*) is readily equalized by agitating the gas-liquid two-phase refrigerant which has been supplied to the first header collecting pipe (60) and guided to the mixing chamber (63). Thus, the present invention allows for equalizing the wetness of the refrigerant to flow in the respective flat tubes (32).

Here, the gas-liquid two-phase refrigerant which has flowed into the mixing chamber (63) is subjected to gravity. Thus, if the height of the mixing chamber (63) exceeds a certain value, the difference in the wetness of the refrigerant between upper and lower end portions of the mixing chamber (63) may widen to a non-negligible extent.

To overcome this problem, according to the present invention, the auxiliary horizontal partition plate (85*a*), which defines the mixing chamber (63) along with the vertical partition plate (90), is arranged between the main horizontal partition plates (80*a*, 80*b*) which are vertically adjacent to each other. This configuration allows for setting the height of the mixing chamber (63), irrespective of the interval between the main horizontal partition plates (80*a*, 80*b*). This configuration of the present invention therefore allows for a reduction in the height of the mixing chamber (63) by arranging the auxiliary horizontal partition plate (85*a*) at an appropriate position. As a result, the gas-liquid two-phase refrigerant in the mixing chamber (63) is homogenized, and the refrigerant having an equal wetness flows in the respective flat tubes.

According to the second aspect of the invention, the mixing chamber (63) is shorter in height than the communication chamber (62*b*) which is adjacent to the mixing chamber (63) with the vertical partition plate (90) interposed between the chambers (63, 62*b*). This thus allows for a reduction in the height of the mixing chamber (63), and the mixing chamber (63) with such a reduced height allows for homogenization of the gas-liquid two-phase refrigerant present in the mixing chamber (63).

According to the third aspect of the invention, the vertical partition plate (90) which defines the mixing chamber (63) is arranged opposite the flat tubes (32) with respect to the central axis (64) of the first header collecting pipe (60). This configuration allows for shortening the width of the mixing chamber (63) to less than half the internal diameter of the first header collecting pipe (60), and hence reducing the capacity of the mixing chamber (63). Consequently, the gas-liquid two-phase refrigerant present in the mixing chamber (63) is homogenized.

According to the tenth aspect of the invention, the gas-liquid two-phase refrigerant which has flowed in the mixing chamber (63) through the connection port (66) collides against the vertical partition plate (90). Due to this collision against the vertical partition plate (90), the refrigerant which has flowed in the mixing chamber (63) through the connection port (66) is vigorously agitated. This configuration of the present invention allows for promoting mixture of the gas and liquid refrigerants included in the refrigerant in the mixing chamber (63), and promoting homogenization of the gas-liquid two-phase refrigerant in the mixing chamber (63).

In addition, according to the tenth aspect of the invention, the communication through holes (95) of the vertical partition plate (90) are arranged so as not to face the connection port (66). Thus, this structure prevents the refrigerant which has flowed into the mixing chamber (63) through the connection port (66) from converging toward the communication through holes (95) of the vertical partition plate (90).

BRIEF DESCRIPTION OF THE DRAWINGS

FIG. 6A illustrates a part of a cross section taken along the plane Q-Q of FIG. 5. FIG. 6B illustrates a cross section taken along the plane R-R of FIG. 6A. FIG. 6C illustrates a cross section taken along the plane S-S of FIG. 6A. FIG. 6D illustrates a cross section taken along the plane T-T of FIG. 6A.

FIG. 11A illustrates a cross section taken along the plane V-V of FIG. 10. FIG. 11B illustrates a cross section taken along the plane W-W of FIG. 10. FIG. 11C illustrates a cross section taken along the plane X-X of FIG. 10, FIG. 11D illustrates a cross section taken along the plane Y-Y of FIG. 10. FIG. 11E illustrates a cross section taken along the plane Z-Z of FIG. 10.

FIG. 13A illustrates a cross section corresponding to FIG. 6B. FIG. 13B illustrates a cross section corresponding to FIG. 6C.

DESCRIPTION OF EMBODIMENTS

Embodiments of the present invention will be described in detail with reference to the drawings. The following embodiments and variations are merely preferred examples in nature, and are not intended to limit the scope, applications, and use of the invention.

First Embodiment of the Invention

A first embodiment of the present invention will be described. A heat exchanger of the present embodiment is an outdoor heat exchanger (23) provided for an air conditioner (10). In the following description, the air conditioner (10) will be described first, and then the outdoor heat exchanger (23) will be described in detail.

—Air Conditioner—

Figure 1:
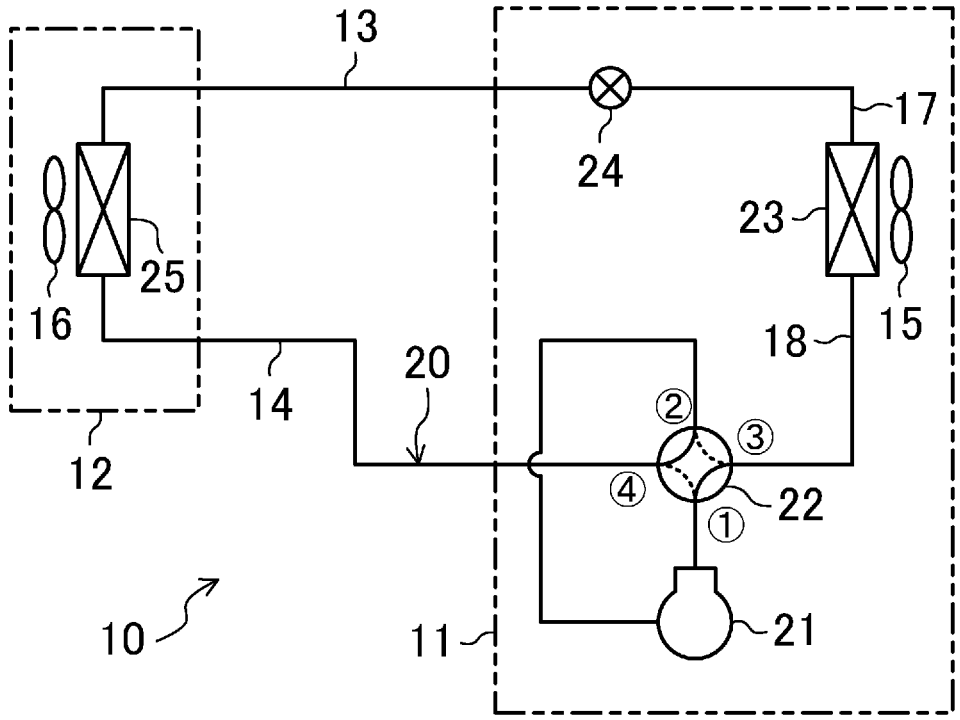
FIG. 1 is a refrigerant circuit diagram illustrating a general configuration of an air conditioner including an outdoor heat exchanger of a first embodiment.

The air conditioner (10) will be described with reference to FIG. 1.

<Configuration of Air Conditioner>

The air conditioner (10) includes an outdoor unit (11) and an indoor unit (12). The outdoor unit (11) and the indoor unit (12) are connected to each other through a liquid-side communication pipe (13) and a gas-side communication pipe (14). In the air conditioner (10), the outdoor unit (11), the indoor unit (12), the liquid-side communication pipe (13), and the gas-side communication pipe (14) form a refrigerant circuit (20).

The refrigerant circuit (20) includes a compressor (21), a four-way valve (22), the outdoor heat exchanger (23), an expansion valve (24), and an indoor heat exchanger (25). The compressor (21), the four-way valve (22), the outdoor heat exchanger (23), and the expansion valve (24) are housed in the outdoor unit (11). The outdoor unit (11) is provided with an outdoor fan (15) for supplying outdoor air to the outdoor heat exchanger (23). On the other hand, the indoor heat exchanger (25) is housed in the indoor unit (12). The indoor unit (12) is provided with an indoor fan (16) for supplying room air to the indoor heat exchanger (25).

The refrigerant circuit (20) is a closed circuit filled with a refrigerant. In the refrigerant circuit (20), the compressor (21) has its discharge pipe and suction pipe respectively connected to a first port and second port of the four-way valve (22). Further, in the refrigerant circuit (20), the outdoor heat exchanger (23), the expansion valve (24), and the indoor heat exchanger (25) are arranged in this order from a third port to a fourth port of the four-way valve (22).

The compressor (21) is a hermetic scroll compressor or a hermetic rotary compressor. The four-way valve (22) is switched between a first state (the state indicated by the solid line in FIG. 1) in which the first port communicates with the third port, and the second port communicates with the fourth port, and a second state (the state indicated by the broken line in FIG. 1) in which the first port communicates with the fourth port, and the second port communicates with the third port. The expansion valve (24) is a so-called electronic expansion valve.

The outdoor heat exchanger (23) exchanges heat between outdoor air and the refrigerant. The outdoor heat exchanger (23) will be described later. On the other hand, the indoor heat exchanger (25) exchanges heat between room air and the refrigerant. The indoor heat exchanger (25) is configured as a so-called "cross-fin type fin-and-tube heat exchanger" having a heat transfer pipe that is a circular pipe.

<Operation of Air Conditioner>

The air conditioner (10) selectively performs a cooling operation and a heating operation. The refrigerant circuit (20) of the air conditioner (10) performs a refrigeration cycle by circulating the refrigerant in each of the cooling and heating operations.

The four-way valve (22) is set to be the first state in the refrigerant circuit (20) during the cooling operation. In this state, the refrigerant circulates through the outdoor heat exchanger (23), the expansion valve (24), and the indoor heat exchanger (25) in this order in the refrigerant circuit (20), with the outdoor heat exchanger (23) functioning as a condenser, and the indoor heat exchanger (25) as an evaporator. In the outdoor heat exchanger (23), a gas refrigerant which has flowed in from the compressor (21) dissipates heat to outdoor air, and is condensed. The condensed refrigerant flows out to the expansion valve (24).

The four-way valve (22) is set to be the second state in the refrigerant circuit (20) during the heating operation. In this state, the refrigerant circulates through the indoor heat exchanger (25), the expansion valve (24), and the outdoor heat exchanger (23) in this order in the refrigerant circuit (20), with the indoor heat exchanger (25) functioning as a condenser, and the outdoor heat exchanger (23) as an evaporator. The refrigerant expands and turns into a gas-liquid two-phase refrigerant when passing through the expansion valve (24). Then, the gas-liquid two-phase refrigerant flows into the outdoor heat exchanger (23). The refrigerant which has flowed into the outdoor heat exchanger (23) absorbs heat from outdoor air and evaporates, and then flows out to the compressor (21).

—Outdoor Heat Exchanger—

The outdoor heat exchanger (23) will be described with reference to FIGS. 2-7 as appropriate. The number of flat tubes (31, 32), the number of main heat exchange portions (51*a*-51*c*), and the number of auxiliary heat exchange portions (52*a*-52*c*) which will be adopted in the following description are merely examples.

<Configuration of Outdoor Heat Exchanger>

Figure 2:
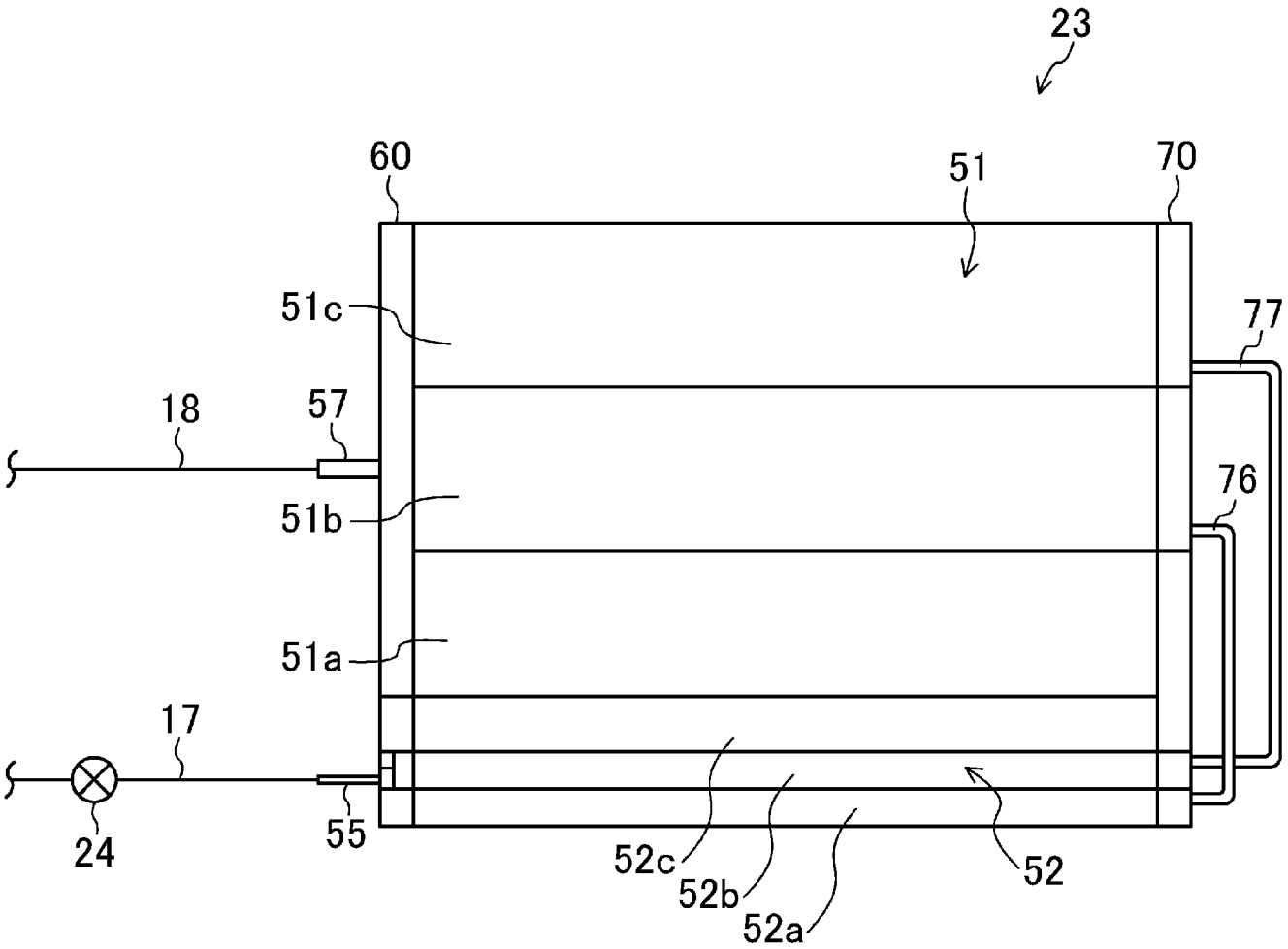
FIG. 2 is a front view illustrating a general configuration of the outdoor heat exchanger of the first embodiment.
Figure 3:
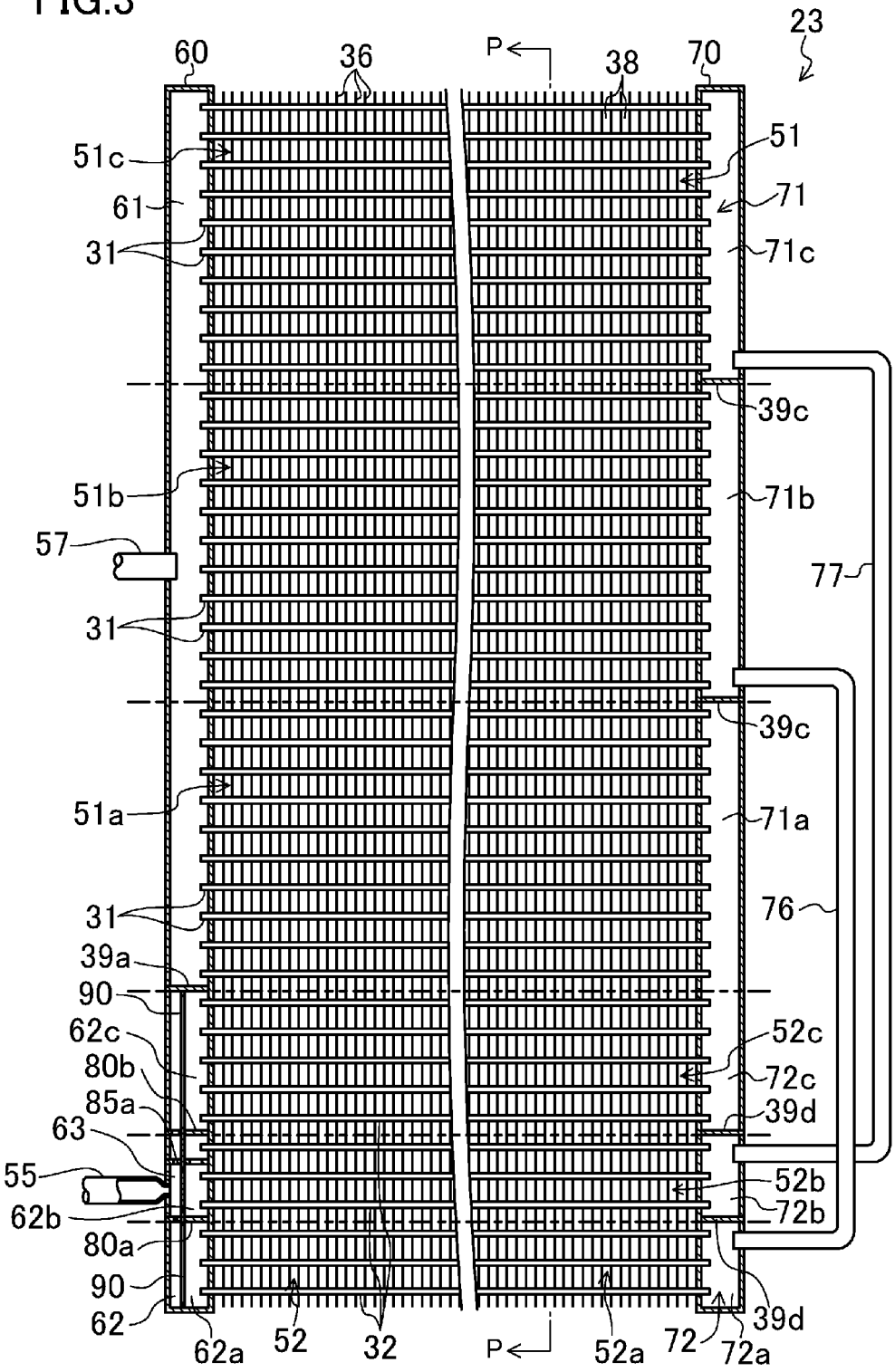
FIG. 3 is a partial cross-sectional view illustrating a front side of the outdoor heat exchanger of the first embodiment.

As illustrated in FIG. 2 and FIG. 3, the outdoor heat exchanger (23) includes a first header collecting pipe (60), a second header collecting pipe (70), a multitude of flat tubes (31, 32), and a multitude of fins (36). All of the first header collecting pipe (60), the second header collecting pipe (70), the flat tubes (31, 32), and the fins (36) are aluminum alloy members, and connected together by brazing.

As will be described in detail later, the outdoor heat exchanger (23) is divided into a main heat exchange region (51) and an auxiliary heat exchange region (52). In this outdoor heat exchanger (23), some flat tubes (32) form the auxiliary heat exchange region (52), and the other flat tubes (31) form the main heat exchange region (51).

The first header collecting pipe (60) and the second header collecting pipe (70) are each formed in an elongated cylindrical shape with both ends closed. In FIGS. 2 and 3, the first header collecting pipe (60) is disposed upright at the left end of the outdoor heat exchanger (23), and the second header collecting pipe (70) is disposed upright at the right end of the outdoor heat exchanger (23). That is, each of the first header collecting pipe (60) and the second header collecting pipe (70) is disposed with its axis extending vertically.

Figure 4:
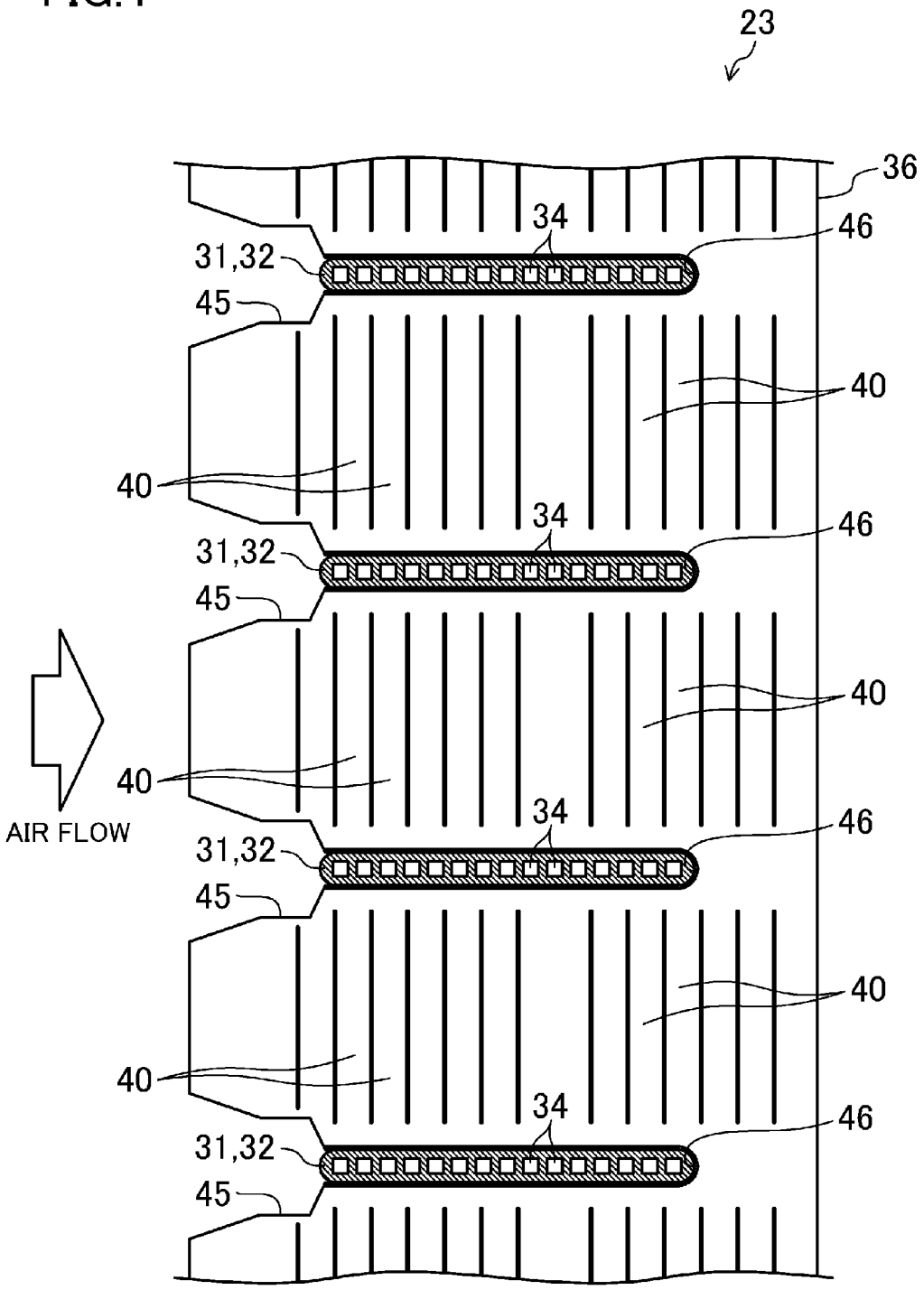
FIG. 4 is a cross-sectional view of the outdoor heat exchanger illustrating, on a larger scale, a part of a cross section thereof taken along the plane P-P of FIG. 3.

As illustrated in FIG. 4, each of the flat tubes (31, 32) is a heat transfer pipe having a flat oblong cross section. As illustrated in FIG. 3, the plurality of flat tubes (31, 32) extend horizontally in the outdoor heat exchanger (23), and are arranged such that their flat side surfaces face each other. Further, the plurality of flat tubes (31, 32) are arranged at regular intervals in the vertical direction. That is, the flat tubes (31, 32) are substantially parallel to each other. One end of each of the flat tubes (31, 32) is inserted in the first header collecting pipe (60), and the other end thereof is inserted in the second header collecting pipe (70).

As illustrated in FIG. 4, the flat tubes (31, 32) each have a plurality of fluid passages (34). The plurality of fluid passages (34) extend in the direction in which the flat tubes (31, 32) extend. In each of the flat tubes (31, 32), the plurality of fluid passages (34) are arranged in line in the width direction (i.e., the direction orthogonal to the longitudinal direction) of the flat tubes (31, 32). One end of each of the plurality of fluid passages (34) defined in the respective flat tubes (31, 32) communicates with the internal space of the first header collecting pipe (60), and the other end thereof communicates with the internal space of the second header collecting pipe (70). The refrigerant supplied to the outdoor heat exchanger (23) exchanges heat with air, while flowing through the fluid passages (34) of the flat tubes (31, 32).

As illustrated in FIG. 4, each of the fins (36) is an elongated plate-shaped fin formed by pressing a metallic plate. The fin (36) is provided with a multitude of narrow cutouts (45) each extending from a front edge (i.e., a windward edge) of the fin (36) in the width direction of the fin (36). These cutouts (45) are arranged at regular intervals in the longitudinal direction (i.e., the vertical direction) of the fin (36). A leeward portion of the cutout (45) functions as a pipe insertion portion (46). The width of the pipe insertion portion (46) in the vertical direction is substantially equal to the thickness of the flat tube (31, 32), and the length of the pipe insertion portion (46) is substantially equal to the width of the flat tube (31, 32). Each of the flat tubes (31, 32) is inserted in an associated one of the pipe insertion portions (46) of the fin (36), and is connected to a peripheral portion of the pipe insertion portion (46) by brazing. Further, the fins (36) are each provided with louvers (40) which promote transfer of heat. The plurality of fins (36) are arranged in the extension direction of the flat tubes (31, 32), thereby partitioning the gap between adjacent flat tubes (31, 32) into a plurality of ventilation passages (38) through which air passes.

As illustrated in FIGS. 2 and 3, the outdoor heat exchanger (23) is divided into two heat exchange regions (51, 52) arranged one above the other. In the outdoor heat exchanger (23), the upper heat exchange region serves as the main heat exchange region (51), and the lower heat exchange region serves as the auxiliary heat exchange region (52).

Each of the heat exchange regions (51, 52) is subdivided into three heat exchange portions (51*a*-51*c*, 52*a*-52*c*) arranged one above the other. That is, in the outdoor heat exchanger (23), each of the main and auxiliary heat exchange regions (51, 52) is divided into a plurality of, and the same number of, heat exchange portions (51*a*-51*c*, 52*a*-52*c*). The number of the heat exchange portions (51*a*-51*c*, 52*a*-52*c*) per heat exchange region (51, 52) may be two, or may even be four or more.

Specifically, the main heat exchange region (51) includes a first main heat exchange portion (51*a*), a second main heat exchange portion (51*b*), and a third main heat exchange portion (51*c*), which are arranged in this order from bottom to top. The auxiliary heat exchange region (52) includes a first auxiliary heat exchange portion (52*a*), a second auxiliary heat exchange portion (52*b*), and a third auxiliary heat exchange portion (52*c*), which are arranged in this order from bottom to top. The main heat exchange portions (51*a*-51*c*) and the auxiliary heat exchange portions (52*a*-52*c*) each have a plurality of flat tubes (31, 32). Further, as illustrated in FIG. 3, the number of flat tubes (31) which constitute each of the main heat exchange portions (51*a*-51*c*) is greater than the number of flat tubes (32) which constitute each of the auxiliary heat exchange portions (52*a*-52*c*). Thus, the number of flat tubes (31) which constitute the main heat exchange region (51) is greater than the number of flat tubes (32) which constitute the auxiliary heat exchange region (52).

In the outdoor heat exchanger (23) of the present embodiment, the number of flat tubes (32) which constitute the first auxiliary heat exchange portion (52*a*) is three, and the number of flat tubes (32) which constitute the second auxiliary heat exchange portion (52*b*) is three, and the number of flat tubes (32) which constitute the third auxiliary heat exchange portion (52*c*) is five.

As illustrated in FIG. 3, the internal space of the first header collecting pipe (60) is partitioned by a partition plate (39*a*) into upper and lower spaces. In the first header collecting pipe (60), the space over the partition plate (39*a*) defines an upper space (61), and the space under the partition plate (39*a*) defines a lower space (62).

The upper space (61) constitutes a main communication space provided for the main heat exchange region (51). The upper space (61) is a single space that communicates with all of the flat tubes (31) that constitute the main heat exchange region (51). That is, the upper space (61) communicates with the flat tubes (31) in the respective main heat exchange portions (51*a*-51*c*).

The lower space (62) constitutes an auxiliary communication space provided for the auxiliary heat exchange region (52). As will be described in detail later, the lower space (62) is divided into the same number of communication chambers (62*a*-62*c*) (three communication chambers in the present embodiment) as that of the auxiliary heat exchange portions (52*a*-52*c*). The first communication chamber (62*a*) located lowermost communicates with all of the flat tubes (32) that constitute the first auxiliary heat exchange portion (52*a*). The second communication chamber (62*b*) located above the first communication chamber (62*a*) communicates with all of the flat tubes (32) that constitute the second auxiliary heat exchange portion (52*b*). The third communication chamber (62*c*) located uppermost communicates with all of the flat tubes (32) that constitute the third auxiliary heat exchange portion (52*c*).

The internal space of the second header collecting pipe (70) is divided into a main communication space (71) provided for the main heat exchange region (51), and an auxiliary communication space (72) provided for the auxiliary heat exchange region (52).

The main communication space (71) is partitioned, by two partition plates (39*c*), into spaces arranged one above the other. The partition plates (39*c*) divide the main communication space (71) into the same number of sub-spaces (71*a*-71*c*) (three sub-spaces in the present embodiment) as that of the main heat exchange portions (51*a*-51*c*). The first sub-space (71*a*) located lowermost communicates with all of the flat tubes (31) that constitute the first main heat exchange portion (51*a*). The second sub-space (71*b*) located above the first sub-space (71*a*) communicates with all of the flat tubes (31) that constitute the second main heat exchange portion (51*b*). The third sub-space (71*c*) located uppermost communicates with all of the flat tubes (31) that constitute the third main heat exchange portion (51*c*).

The auxiliary communication space (72) is partitioned, by two partition plates (39*d*), into spaces arranged one above the other. The partition plates (39*d*) divide the auxiliary communication space (72) into the same number of sub-spaces (72*a*-72*c*) (three sub-spaces in the present embodiment) as that of the auxiliary heat exchange portions (52*a*-52*c*). The fourth sub-space (72*a*) located lowermost communicates with all of the flat tubes (32) that constitute the first auxiliary heat exchange portion (52*a*). The fifth sub-space (72*b*) located above the fourth sub-space (72*a*) communicates with all of the flat tubes (32) that constitute the second auxiliary heat exchange portion (52*b*). The sixth sub-space (72*c*) located uppermost communicates with all of the flat tubes (32) that constitute the third auxiliary heat exchange portion (52*c*).

Two connecting pipes (76, 77) are attached to the second header collecting pipe (70). Both of these connecting pipes (76, 77) are circular pipes.

One end of the first connecting pipe (76) is connected to the second sub-space (71*b*) provided for the second main heat exchange portion (51*b*), and the other end of the first connecting pipe (76) is connected to the fourth sub-space (72*a*) provided for the first auxiliary heat exchange portion (52*a*). One end of the second connecting pipe (77) is connected to the third sub-space (71*c*) provided for the third main heat exchange portion (51*c*), and the other end of the second connecting pipe (77) is connected to the fifth sub-space (72*b*) provided for the second auxiliary heat exchange portion (52*b*). In the second header collecting pipe (70), the sixth sub-space (72*c*) provided for the third auxiliary heat exchange portion (52*c*) and the first sub-space (71*a*) provided for the first main heat exchange portion (51*a*) form a single continuous space.

Thus, in the outdoor heat exchanger (23) of the present embodiment, the first main heat exchange portion (51*a*) and the third auxiliary heat exchange portion (52*c*) are connected to each other in series, and the second main heat exchange portion (51*b*) and the first auxiliary heat exchange portion (52*a*) are connected to each other in series, and the third main heat exchange portion (51*c*) and the second auxiliary heat exchange portion (52*b*) are connected to each other in series.

As illustrated in FIG. 2 and FIG. 3, the outdoor heat exchanger (23) is provided with a liquid-side connecting pipe (55) and a gas-side connecting pipe (57). The liquid-side and gas-side connecting pipes (55, 57) are aluminum alloy members formed in the shape of a circular pipe. The liquid-side and gas-side connecting pipes (55, 57) are each connected to the first header collecting pipe (60) by brazing.

As will be described in detail later, one end of the liquid-side connecting pipe (55), which is a tubular member, is connected to a lower portion of the first header collecting pipe (60), and communicates with the lower space (62). The other end of the liquid-side connecting pipe (55) is connected to a copper pipe (17) connecting the outdoor heat exchanger (23) and the expansion valve (24), via a joint (not shown).

One end of the gas-side connecting pipe (57) is connected to an upper portion of the first header collecting pipe (60), and communicates with the upper space (61). The other end of the gas-side connecting pipe (57) is connected to a copper pipe (18) connecting the outdoor heat exchanger (23) and the third port of the four-way valve (22), via a joint (not shown).

<Configuration of Lower Portion of First Header Collecting Pipe>

The structure of the lower portion of the first header collecting pipe (60) will be described in detail with reference to FIGS. 5-7 as appropriate. In the following description, a side surface of the first header collecting pipe (60) which faces the flat tubes (32) will be hereinafter referred to as a "front surface," and another side surface of the first header collecting pipe (60) which faces away from the flat tubes (32) will be hereinafter referred to as a "rear surface."

Figure 5:
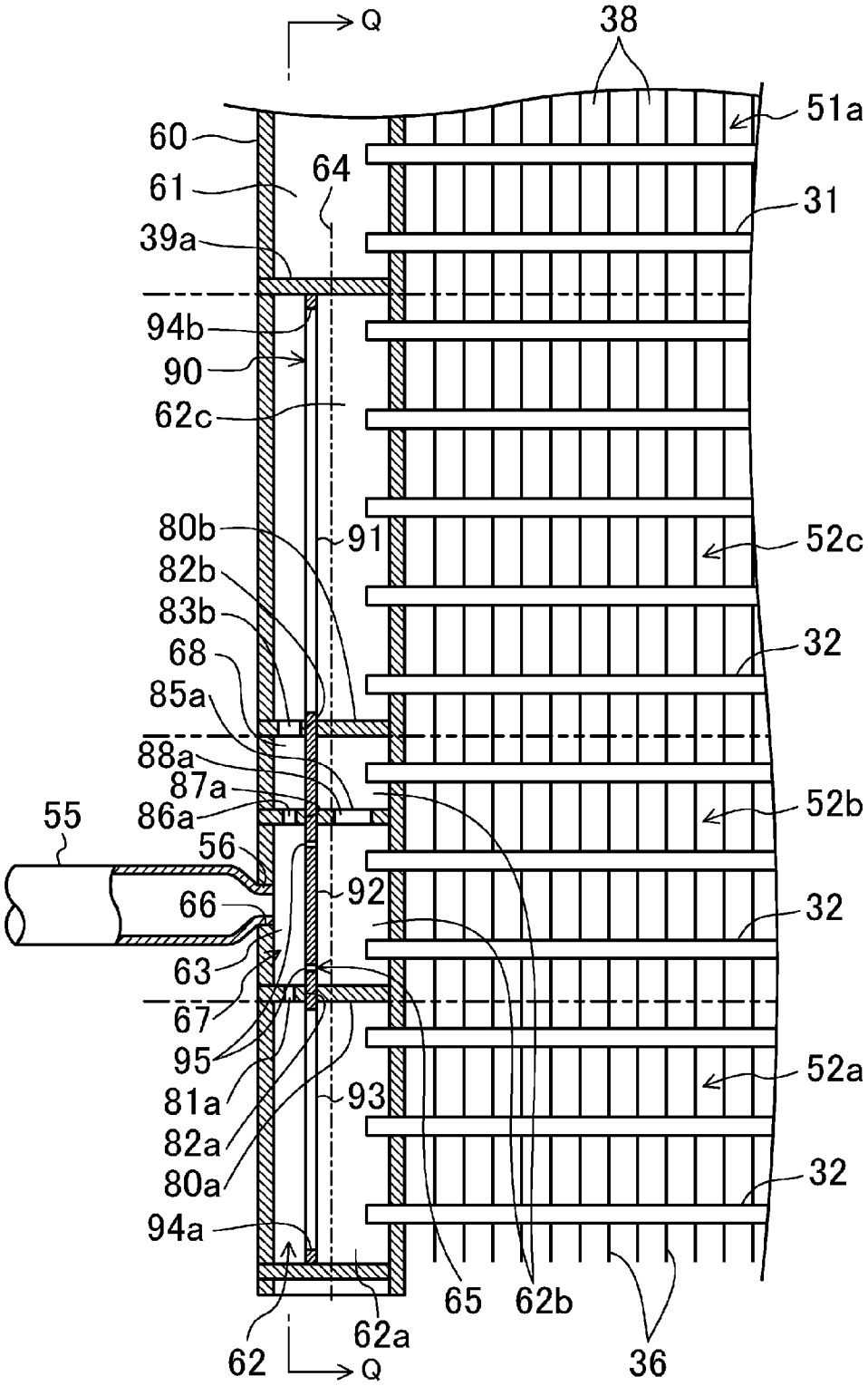
FIG. 5 is a cross-sectional view illustrating, on a larger scale, the front side of a main part of the outdoor heat exchanger according to the first embodiment.

The lower space (62) of the first header collecting pipe (60) is provided with a first main horizontal partition plate (80*a*), a second main horizontal partition plate (80*b*), an auxiliary horizontal partition plate (85*a*), and a vertical partition plate (90) (see FIG. 5). The lower space (62) is partitioned into three communication chambers (62*a*-62*c*) and one mixing chamber (63) by the two main horizontal partition plates (80*a*, 80*b*), the single auxiliary horizontal partition plate (85*a*), and the single vertical partition plate (90). The first main horizontal partition plate (80*a*), the second main horizontal partition plate (80*b*), the auxiliary horizontal partition plate (85*a*), and the vertical partition plate (90) are made of an aluminum alloy.

Each of the first main horizontal partition plate (80*a*), the second main horizontal partition plate (80*b*), and the auxiliary horizontal partition plate (85*a*) is a member in an approximately disk-like shape, and is arranged to cross horizontally the lower space (62). That is, the first main horizontal partition plate (80*a*), the second main horizontal partition plate (80*b*), and the auxiliary horizontal partition plate (85*a*) divide the lower space (62) into spaces one above the other. The first main horizontal partition plate (80*a*), the second main horizontal partition plate (80*b*), and the auxiliary horizontal partition plate (85*a*) are connected to the first header collecting pipe (60) by brazing.

The first main horizontal partition plate (80*a*) is arranged at the boundary between the first auxiliary heat exchange portion (52*a*) and the second auxiliary heat exchange portion (52*b*), and separates the first communication chamber (62*a*) and the second communication chamber (62*b*) from each other. The second main horizontal partition plate (80*b*) is arranged at the boundary between the second auxiliary heat exchange portion (52*b*) and the third auxiliary heat exchange portion (52*c*), and separates the second communication chamber (62*b*) and the third communication chamber (62*c*) from each other. The auxiliary horizontal partition plate (85*a*) is arranged between the second and third lowermost ones (32) of the three flat tubes (32) that constitute the second auxiliary heat exchange portion (52*b*). That is, the auxiliary horizontal partition plate (85*a*) is arranged between the first main horizontal partition plate (80*a*) and the second main horizontal partition plate (80*b*).

The first main horizontal partition plate (80*a*), the second main horizontal partition plate (80*b*), and the auxiliary horizontal partition plate (85*a*) are each provided with a slit hole (82*a*, 82*b*, 87*a*) (see FIG. 5 and FIG. 6). The slit holes (82*a*, 82*b*, 87*a*) each have an elongated rectangular shape, and pass through the horizontal partition plates (80*a*, 80*b*, 85*a*) in the thickness direction. The longer sides of the slit holes (82*a*, 82*b*, 87*a*) are substantially parallel to the end faces of the flat tubes (32). In the first main horizontal partition plate (80*a*), the second main horizontal partition plate (80*b*), and the auxiliary horizontal partition plate (85*a*), the slit holes (82*a*, 82*b*, 87*a*) are located closer to the rear surface of the first header collecting pipe (60) than the central axis (64) of the first header collecting pipe (60) is. The slit holes (82*a*, 82*b*, 87*a*) each have a width that is almost equal to the thickness of the vertical partition plate (90), and a length that is almost equal to the width of the vertical partition plate (90).

Figure 6A:
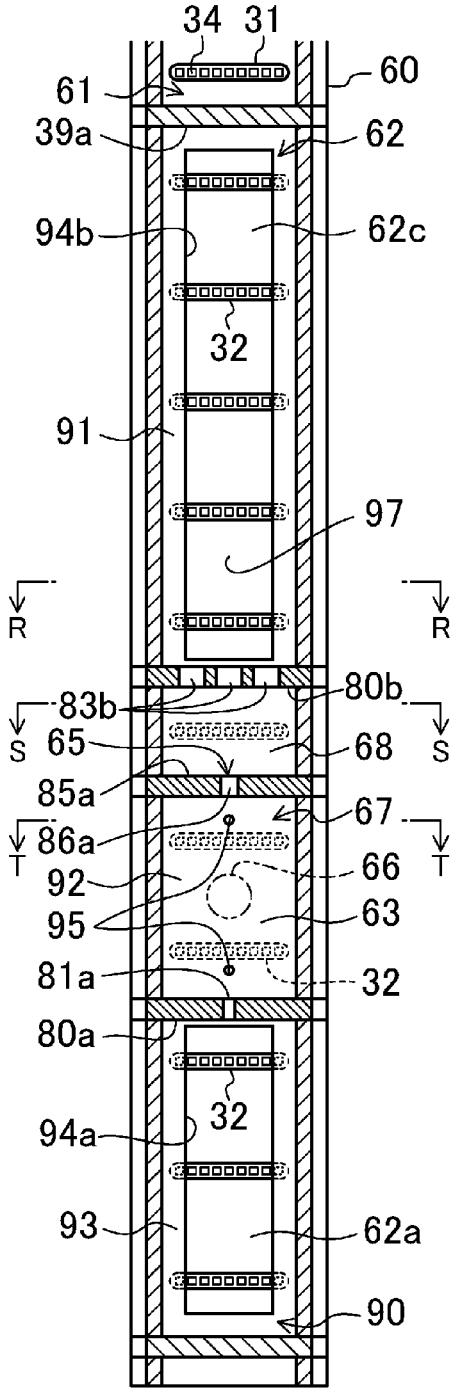
FIGS. 6A to 6D are cross-sectional views illustrating, on a larger scale, a main part of the outdoor heat exchanger of the first embodiment.
Figure 6B:
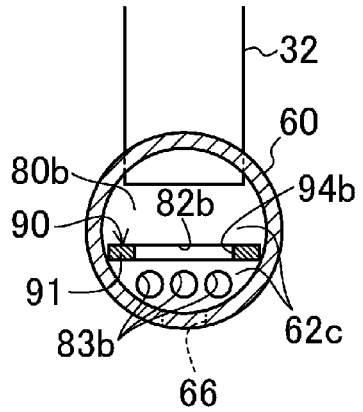
Figure 6C:
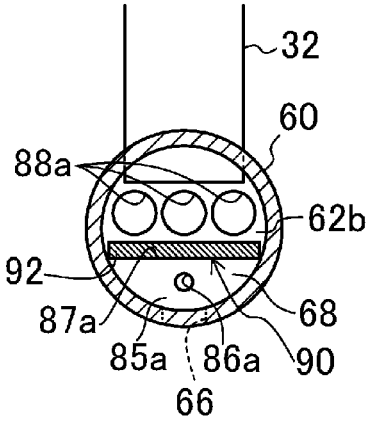
Figure 6D:
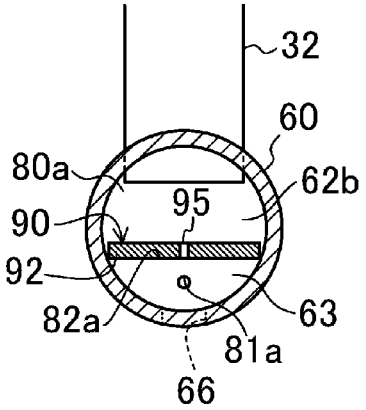

As illustrated in FIG. 6D, the first main horizontal partition plate (80*a*) has a flow rate adjusting hole (81*a*). The flow rate adjusting hole (81*a*) is a circular hole which passes through the first main horizontal partition plate (80*a*) in the thickness direction. The flow rate adjusting hole (81*a*) is arranged closer to the rear surface of the first header collecting pipe (60) than the slit hole (82*a*) is.

As illustrated in FIG. 6B, the second main horizontal partition plate (80*b*) has three connecting holes (83*b*). Each of these connecting holes (83*b*) is a circular hole which passes through the second main horizontal partition plate (80*b*) in the thickness direction. The three connecting holes (83*b*) are arranged closer to the rear surface of the first header collecting pipe (60) than the slit hole (82*a*) is.

As illustrated in FIG. 6C, the auxiliary horizontal partition plate (85*a*) has one flow rate adjusting hole (86*a*) and three connecting holes (88*a*). Each of these flow rate adjusting hole (86*a*) and connecting holes (88*a*) is a circular hole which passes through the auxiliary horizontal partition plate (85*a*) in the thickness direction. The flow rate adjusting hole (86*a*) is arranged closer to the rear surface of the first header collecting pipe (60) than the slit hole (87*a*) is. The three connecting holes (88*a*) are arranged closer to the front surface of the first header collecting pipe (60) than the slit hole (87*a*) is.

Figure 7:
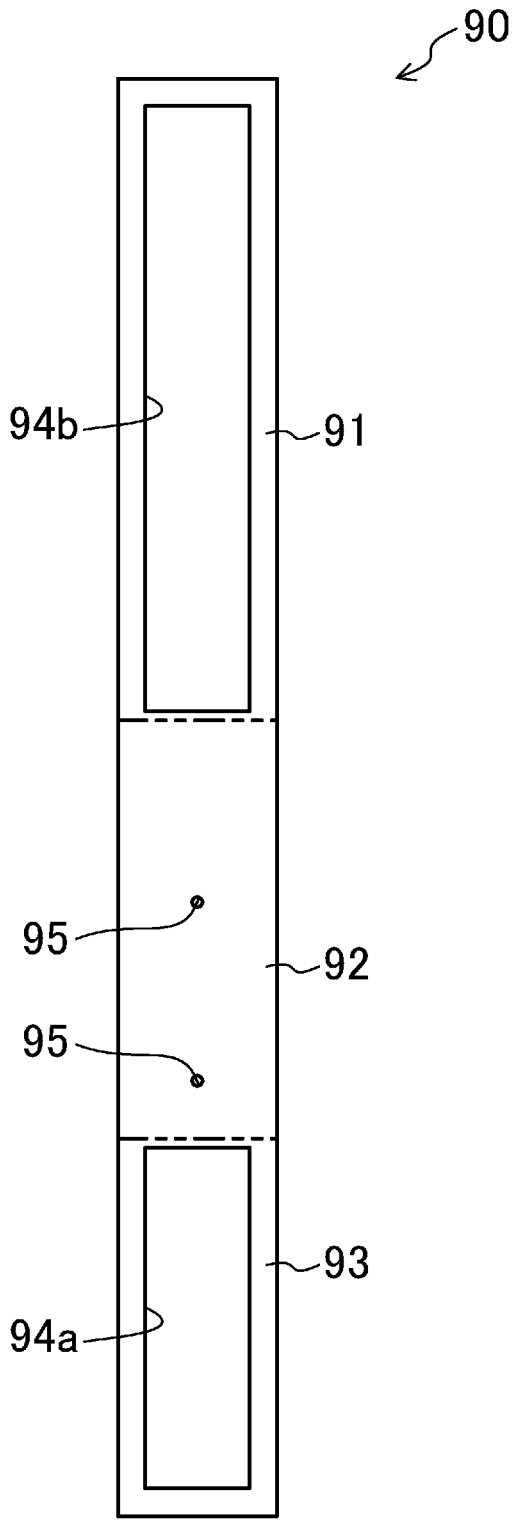
FIG. 7 is a plan view of a vertical partition plate provided for the outdoor heat exchanger of the first embodiment.

The vertical partition plate (90) has an elongated rectangular plate-like shape (see FIG. 7). The vertical partition plate (90) passes through the slit hole (82*a*) of the first main horizontal partition plate (80*a*), the slit hole (82*b*) of the second main horizontal partition plate (80*b*), and the slit hole (87*a*) of the auxiliary horizontal partition plate (85*a*) (see FIGS. 5 and 6). The vertical partition plate (90) vertically runs through the lower space (62) in the first header collecting pipe (60). The vertical partition plate (90) faces the respective end faces of the flat tubes (32) inserted in the first header collecting pipe (60).

The lower end of the vertical partition plate (90) contacts with the bottom of the first header collecting pipe (60), and the upper end thereof contacts with the partition plate (39*a*). Further, both ends in the width direction (i.e., the horizontal direction in FIG. 6) of the vertical partition (90) contact with the inner peripheral surface of the first header collecting pipe (60). The vertical partition plate (90) is not connected to any other member. This vertical partition plate (90) has its position held by being inserted in the respective slit holes (82*a*, 82*b*, 87*a*) of the main horizontal partition plates (80*a*, 80*b*) and brought into contact with the partition plate (39*a*) and the bottom of the first header collecting pipe (60).

The vertical partition plate (90) includes an upper portion (91) located over the second main horizontal partition plate (80*b*), a middle portion (92) located between the second and first main horizontal partition plates (80*b*, 80*a*), and a lower portion (93) located under the first main horizontal partition plate (80*a*) (see FIGS. 5 and 6).

The middle portion (92) of the vertical partition plate (90) partitions a portion of the lower space (62), which is sandwiched between the second and first main horizontal partition plates (80*b*, 80*a*), into two spaces located closer to the front and rear surfaces of the first header collecting pipe (60). The space located closer to the front surface of the first header collecting pipe (60) with respect to the middle portion (92) of the vertical partition plate (90) is the second communication chamber (62*b*). The space located closer to the rear surface of the first header collecting pipe (60) with respect to the middle portion (92) of the vertical partition plate (90) is a rear space (67).

The rear space (67) is partitioned by the auxiliary horizontal partition plate (85*a*) into spaces arranged one above the other. An upper portion of the rear space (67) located over the auxiliary horizontal partition plate (85*a*) defines an intermediate chamber (68), and a lower portion of the rear space (67) located under the auxiliary horizontal partition plate (85*a*) defines the mixing chamber (63). That is, the auxiliary horizontal partition plate (85*a*) partitions the rear space (67) into the mixing chamber (63) and the intermediate chamber (68).

Thus, the mixing chamber (63) is surrounded by the middle portion (92) of the vertical partition plate (90), the first main horizontal partition plate (80*a*), the auxiliary horizontal partition plate (85*a*), and the sidewall portion of the first header collecting pipe (60). That is, in the first header collecting pipe (60), the mixing chamber (63) lies next to the second communication chamber (62*b*) with the middle portion (92) of the vertical partition plate (90) interposed between the chambers (63, 62*b*).

Further, the auxiliary horizontal partition plate (85*a*) is disposed between the first main horizontal partition plate (80*a*) and the second main horizontal partition plate (80*b*). Thus, the height of the mixing chamber (63) interposed between the first main horizontal partition plate (80*a*) and the auxiliary horizontal partition plate (85*a*) is shorter than the height of the second communication chamber (62*b*) interposed between the first main horizontal partition plate (80*a*) and the second main horizontal partition plate (80*b*).

The vertical partition plate (90) is provided with two rectangular openings (94*a*, 94*b*) and two circular flow rate adjusting holes (95, 95). Each of the openings (94*a*, 94*b*) and flow rate adjusting holes (95, 95) passes through the vertical partition plate (90) in its thickness direction.

The openings (94*b*, 94*a*) are respectively cut through the upper portion (91) and lower portion (93) of the vertical partition plate (90). The upper opening (94*b*) forms a large area of the upper portion (91) of the vertical partition plate (90). Thus, in the third communication chamber (62*c*) located over the second main horizontal partition plate (80*b*), the spaces on both sides of the vertical partition plate (90) constitute substantially a single space. The lower opening (94*a*) forms a large area of the lower portion (93) of the vertical partition plate (90). Thus, in the first communication chamber (62*a*) located under the first main horizontal partition plate (80*a*), the spaces on both sides of the vertical partition plate (90) constitute substantially a single space.

Both of the two flow rate adjusting holes (95) are circular holes which pass through the vertical partition plate (90) in its thickness direction. These flow rate adjusting holes (95) are cut through a region of the middle portion (92) of the vertical partition plate (90) so as to be located between the first main horizontal partition plate (80*a*) and the auxiliary horizontal partition plate (85*a*) (i.e., a region facing the mixing chamber (63)). Further, the two flow rate adjusting holes (95) are arranged one above the other along a center line of the width dimension of the vertical partition plate (90). That is, one of the two flow rate adjusting holes (95) is arranged near the auxiliary horizontal partition plate (85*a*), and the other is arranged near the first main horizontal partition plate (80*a*).

A sidewall portion of the first header collecting pipe (60) is provided with a connection port (66) into which the liquid-side connecting pipe (55) is inserted. The connection port (66) is a circular through hole. The connection port (66) is cut through a region of the first header collecting pipe (60) between the first main horizontal partition plate (80*a*) and the auxiliary horizontal partition plate (85*a*), and communicates with the mixing chamber (63). The connection port (66) is arranged so that its center is located at the middle of the vertical dimension of the mixing chamber (63). The liquid-side connecting pipe (55) has a narrowed connecting end (56) to be inserted in the connection port (66) of the first header collecting pipe (60).

As described above, the flow rate adjusting holes (95) of the vertical partition plate (90) are arranged respectively near the upper and lower ends of a region of the vertical partition plate (90) facing the mixing chamber (63). On the other hand, the center of the connection port (66) is located at the middle of the vertical dimension of the mixing chamber (63). That is, the flow rate adjusting holes (95) of the vertical partition plate (90) are arranged so as not to face the connection port (66).

Further, as described above, the first main horizontal partition plate (80*a*), the auxiliary horizontal partition plate (85*a*), and the vertical partition plate (90) are provided with the flow rate adjusting holes (81*a*, 86*a*, 95). These flow rate adjusting holes (81*a*, 86*a*, 95) are communication through holes for distributing the refrigerant in the mixing chamber (63) to the respective communication chambers (62*a*-62*c*) at a predetermined ratio. These flow rate adjusting holes (81*a*, 86*a*, 95) constitute a distribution passage (65) for distributing the refrigerant in the mixing chamber (63) to the respective communication chambers (62*a*-62*c*) at a predetermined ratio.

The flow rate adjusting hole (81*a*) of the first main horizontal partition plate (80*a*) allows the mixing chamber (63) to communicate with the first communication chamber (62*a*). The flow rate adjusting hole (81*a*) has a diameter of about 2 mm, for example.

The flow rate adjusting hole (86*a*) of the auxiliary horizontal partition plate (85*a*) allows the mixing chamber (63) to communicate with the third communication chamber (62*c*) via the intermediate chamber (68). The flow rate adjusting hole (86*a*) has a slightly larger diameter than the flow rate adjusting hole (81*a*) of the first main horizontal partition plate (80*a*).

The two flow rate adjusting holes (95) of the vertical partition plate (90) allow the mixing chamber (63) to communicate with the second communication chamber (62*b*). The sum of the cross-sectional areas of these two flow rate adjusting holes (95) is substantially equal to the cross-sectional area of the flow rate adjusting hole (81*a*) of the first main horizontal partition plate (80*a*).

Further, as described above, the second main horizontal partition plate (80*b*) is provided with three connecting holes (83*b*). The connecting holes (83*b*) of the second main horizontal partition plate (80*b*) allow the intermediate chamber (68) to communicate with the third communication chamber (62*c*). Each of the connecting holes (83*b*) has a much larger diameter than the flow rate adjusting hole (86*a*) of the auxiliary horizontal partition plate (85*a*). The sum of the cross-sectional areas of these three connecting holes (83*b*) is sufficiently greater than (e.g., ten times or more as large as) the cross-sectional area of the flow rate adjusting hole (86*a*) of the auxiliary horizontal partition plate (85*a*). This means that the intermediate chamber (68) communicates with the third communication chamber (62*c*) through the connecting holes (83*b*), each having a large cross-sectional area, and therefore, the intermediate chamber (68) and the third communication chamber (62*c*) form substantially a single space.

Further, as described above, the auxiliary horizontal partition plate (85*a*) is disposed between the first main horizontal partition plate (80*a*) and the second main horizontal partition plate (80*b*). That is, the auxiliary horizontal partition plate (85*a*) horizontally crosses the second communication chamber (62*b*). On the other hand, the auxiliary horizontal partition plate (85*a*) is provided with three connecting holes (88*a*). Thus, portions of the second communication chamber (62*b*) located over and under the auxiliary horizontal partition plate (85*a*) communicate with each other through the connecting holes (88*a*).

Each of the connecting holes (88*a*) of the auxiliary horizontal partition plate (85*a*) has a much larger diameter than each of the flow rate adjusting holes (95) of the vertical partition plate (90). The sum of the cross-sectional areas of these three connecting holes (88*a*) is sufficiently greater than (e.g., ten times or more as large as) the sum of the cross-sectional areas of the two flow rate adjusting holes (95) of the vertical partition plate (90). This means that the second communication chamber (62*b*) is substantially a single space, although the auxiliary horizontal partition plate (85*a*) is arranged so as to horizontally cross the second communication chamber (62*b*).

<Refrigerant Flow in Outdoor Heat Exchanger Serving as Condenser>

While the air conditioner (10) is performing a cooling operation, the outdoor heat exchanger (23) functions as a condenser. The flow of the refrigerant in the outdoor heat exchanger (23) during the cooling operation will be described.

A gas refrigerant discharged from the compressor (21) is supplied to the outdoor heat exchanger (23). The gas refrigerant supplied from the compressor (21) flows into the upper space (61) of the first header collecting pipe (60) through the gas-side connecting pipe (57), and is then distributed to the respective flat tubes (31) of the main heat exchange region (51). In the main heat exchange portions (51*a*-51*c*) of the main heat exchange region (51), the refrigerant which has flowed into the fluid passages (34) of the flat tubes (31) dissipate heat to the outdoor air while flowing through the fluid passages (34), and is thereby condensed. The refrigerant then flows into respective sub-spaces (71*a*-71*c*) of the second header collecting pipe (70) associated with the main heat exchange portions (51*a*-51*c*).

The refrigerant which has flowed into the sub-spaces (71*a*-71*c*) of the main communication space (71) is guided to the sub-spaces (72*a*-72*c*) of the auxiliary communication space (72) associated with the sub-spaces (71*a*-71*c*). The refrigerant which has flowed into the first sub-space (71*a*) of the main communication space (71) flows down into the sixth sub-space (72*c*) of the auxiliary communication space (72). The refrigerant which has flowed into the second sub-space (71*b*) of the main communication space (71) flows into the fourth sub-space (72*a*) of the auxiliary communication space (72) through the first connecting pipe (76). The refrigerant which has flowed into the third sub-space (71*c*) of the main communication space (71) flows into the fifth sub-space (72*b*) of the auxiliary communication space (72) through the second connecting pipe (77).

The refrigerant which has flowed into the sub-spaces (72*a*-72*c*) of the auxiliary communication space (72) is distributed to the respective flat tubes (32) of the auxiliary heat exchange portion (52*a*-52*c*) associated with the sub-spaces (72*a*-72*c*). The refrigerant flowing in the fluid passages (34) of the flat tubes (32) dissipates heat to the outdoor air to turn into a sub-cooled liquid. The refrigerant then flows into the communication chambers (62*a*-62*c*) in the lower space (62) of the first header collecting pipe (60) associated with the auxiliary heat exchange portions (52*a*-52*c*). After that, the refrigerant flows into the liquid-side connecting pipe (55) via the mixing chamber (63), and then flows out of the outdoor heat exchanger (23).

<Refrigerant Flow in Outdoor Heat Exchanger Serving as Evaporator>

While the air conditioner (10) is performing a heating operation, the outdoor heat exchanger (23) functions as an evaporator. The flow of the refrigerant in the outdoor heat exchanger (23) during the heating operation will be described.

A refrigerant that has expanded and turned into a gas-liquid two-phase refrigerant when passing through the expansion valve (24) is supplied to the outdoor heat exchanger (23). The gas-liquid two-phase refrigerant which has flowed in from the expansion valve (24) passes through the liquid-side connecting pipe (55) inserted in the connection port (66), and flows into the mixing chamber (63) in the first header collecting pipe (60). The flow velocity of the refrigerant rises while the refrigerant is passing through the connecting end (56) of the liquid-side connecting pipe (55), and the refrigerant with a high flow velocity which has been ejected from the liquid-side connecting pipe (55) collides against the vertical partition plate (90). Thus, the refrigerant is vigorously agitated in the mixing chamber (63), and the gas refrigerant and liquid refrigerant in this refrigerant are thus mixed together. That is, the refrigerant in the mixing chamber (63) is homogenized, thereby making the refrigerant in the mixing chamber (63) have approximately a uniform wetness.

The refrigerant in the mixing chamber (63) is distributed to the communication chambers (62*a*-62*c*). As described above, the gas-liquid two-phase refrigerant in the mixing chamber (63) has been homogenized. Thus, the refrigerant having approximately an equal wetness flows into the respective communication chambers (62*a*-62*c*) from the mixing chamber (63).

The refrigerant in the mixing chamber (63) passes through the flow rate adjusting hole (81*a*) of the first main horizontal partition plate (80*a*), and flows into the first communication chamber (62*a*). The refrigerant in the mixing chamber (63) also passes through the flow rate adjusting holes (95) of the vertical partition plate (90), and flows into a lower portion of the second communication chamber (62*b*) under the auxiliary horizontal partition plate (85*a*). Part of the refrigerant which has flowed into that lower portion of the second communication chamber (62*b*) under the auxiliary horizontal partition plate (85*a*) passes through the connecting holes (88*a*) of the auxiliary horizontal partition plate (85*a*), and then flows into the upper portion of the second communication chamber (62*b*) over the auxiliary horizontal partition plate (85*a*). That is, the refrigerant which has passed through the flow rate adjusting holes (95) of the vertical partition plate (90) spreads across the entire second communication chamber (62*b*). Moreover, the refrigerant in the mixing chamber (63) passes through the flow rate adjusting hole (86*a*) of the auxiliary horizontal partition plate (85*a*), and temporarily flows into the intermediate chamber (68), and then passes through the connecting holes (83*b*) of the second main horizontal partition plate (80*b*) and flows into the third communication chamber (62*c*).

In the outdoor heat exchanger (23) of the present embodiment, the sizes of the flow rate adjusting holes (81*a*, 86*a*, 95) which constitute the distribution passage (65) are determined such that the refrigerant is distributed from the mixing chamber (63) to the communication chambers (62*a*-62*c*) at a predetermined ratio. Specifically, in the outdoor heat exchanger (23) of the present embodiment, the distribution ratio of the refrigerant from the mixing chamber (63) to the communication chambers (62*a*-62*c*) is set such that the refrigerant flows, at substantially equal mass flow rates, into the respective flat tubes (32) that constitute the auxiliary heat exchange portions (52*a*-52*c*). Thus, in the outdoor heat exchanger (23) of the present embodiment, the mass flow rate of the refrigerant flowing into the second communication chamber (62*b*) from the mixing chamber (63) is substantially equal to the mass flow rate of the refrigerant flowing into the first communication chamber (62*a*) from the mixing chamber (63). Also, the mass flow rate of the refrigerant flowing into the third communication chamber (62*c*) from the mixing chamber (63) is greater than the mass flow rate of the refrigerant flowing into the first communication chamber (62*a*) from the mixing chamber (63).

The refrigerant which has flowed into the respective communication chambers (62*a*-62*c*) of the first header collecting pipe (60) is distributed to the flat tubes (32) of the auxiliary heat exchange portions (52*a*-52*c*) associated with the communication chambers (62*a*-62*c*). The refrigerant which has flowed into the fluid passages (34) of the flat tubes (32) absorbs heat from the outdoor air while flowing through the fluid passages (34), and part of the liquid refrigerant evaporates. The refrigerant which has passed through the fluid passages (34) of the flat tubes (32) flows into associated ones of the sub-spaces (72*a*-72*c*) of the auxiliary communication space (72) in the second header collecting pipe (70). The refrigerant which has flowed in the sub-spaces (72*a*-72*c*) remains the gas-liquid two-phase refrigerant.

The refrigerant which has flowed into the sub-spaces (72*a*-72*c*) of the auxiliary communication space (72) is guided to associated ones of the sub-spaces (71*a*-71*c*) of the main communication space (71). The refrigerant which has flowed into the fourth sub-space (72*a*) of the auxiliary communication space (72) flows into the second sub-space (71*b*) of the main communication space (71) through the first connecting pipe (76). The refrigerant which has flowed into the fifth sub-space (72*b*) of the auxiliary communication space (72) flows into the third sub-space (71*c*) of the main communication space (71) through the second connecting pipe (77). The refrigerant which has flowed into the sixth sub-space (72*c*) of the auxiliary communication space (72) flows upward to enter the first sub-space (71*a*) of the main communication space (71).

The refrigerant which has flowed into the sub-spaces (71*a*-71*c*) of the main communication space (71) is distributed to the flat tubes (31) of associated ones of the main heat exchange portions (51*a*-51*c*). The refrigerant flowing in the fluid passages (34) of the flat tubes (31) absorbs heat from the outdoor air and evaporates, and turns into gas refrigerant in substantially a single phase, and then flows into the upper space (61) of the first header collecting pipe (60). After that, the refrigerant flows out of the outdoor heat exchanger (23) through the gas-side connecting pipe (57).

—Advantages of First Embodiment—

In the outdoor heat exchanger (23) of the present embodiment, the first header collecting pipe (60) is provided with the main horizontal partition plates (80*a*, 80*b*), the auxiliary horizontal partition plate (85*a*), and the vertical partition plate (90). These partition plates (80*a*, 80*b*, 85*a*, 90) partition the internal space of the first header collecting pipe (60) into one mixing chamber (63) and three communication chambers (62*a*-62*c*). The gas-liquid two-phase refrigerant supplied to the outdoor heat exchanger (23) serving as an evaporator flows into the mixing chamber (63) in the first header collecting pipe (60), and collides against the vertical partition plate (90) and is thereby agitated. Thus, the present embodiment allows for equalizing the wetness of a refrigerant to be distributed to the respective communication chambers (62*a*-62*c*) from the mixing chamber (63), and therefore, also equalizing the wetness of the refrigerant to flow into the respective flat tubes (32) that communicate with the communication chambers (62*a*-62*c*).

Here, the gas-liquid two-phase refrigerant which has flowed into the mixing chamber (63) is subjected to gravity. Thus, if the height of the mixing chamber (63) exceeds a certain value, the difference in the wetness of the refrigerant between upper and lower end portions of the mixing chamber (63) may widen to a non-negligible extent. In addition, if the mixing chamber (63) has a large capacity, the difference in the wetness of the refrigerant among respective portions of the mixing chamber (63) may also widen to a non-negligible extent.

To overcome this problem, the outdoor heat exchanger (23) of the present embodiment is configured such that the auxiliary horizontal partition plate (85*a*), which defines the mixing chamber (63) along with the vertical partition plate (90), is arranged between the first main horizontal partition plate (80*a*) and the second main horizontal partition plate (80*b*) arranged one above the other. This configuration allows for setting the height of the mixing chamber (63), irrespective of the interval between the main horizontal partition plates (80*a*, 80*b*). Thus, in the outdoor heat exchanger (23) of the present embodiment, the height of the mixing chamber (63) is set to be shorter than that of the second communication chamber (62*b*) arranged next to the mixing chamber (63) with the vertical partition plate (90) interposed between the chambers (63, 62*b*).

Further, in the outdoor heat exchanger (23) of the present embodiment, the vertical partition plate (90) which defines the mixing chamber (63) is arranged opposite the flat tubes (32) with respect to the central axis (64) of the first header collecting pipe (60). This allows for a reduction in not only the width of the mixing chamber (63) but also the capacity of the mixing chamber (63) as well.

As can be seen, the outdoor heat exchanger (23) of the present embodiment allows for a reduction in the height, and hence the capacity, of the mixing chamber (63) into which the gas-liquid two-phase refrigerant flows when the outdoor heat exchanger (23) serves as an evaporator. Therefore, the present embodiment enables reducing the difference in the wetness of the refrigerant among respective portions of the mixing chamber (63), and distributing a refrigerant having an equal wetness to the respective communication chambers (62*a*-62*c*) from the mixing chamber (63).

Further, the vertical partition plate (90) in the outdoor heat exchanger (23) of the present embodiment is provided with flow rate adjusting holes (95) which are arranged so as not to face the connection port (66). This structure prevents the refrigerant which has flowed into the mixing chamber (63) through the connection port (66) from converging toward the flow rate adjusting holes (95) of the vertical partition plate (90), and allows the refrigerant to be distributed, with reliability, from the mixing chamber (63) to the communication chambers (62*a*-62*c*) at a predetermined distribution ratio.

—Variation of First Embodiment—

Figure 8:
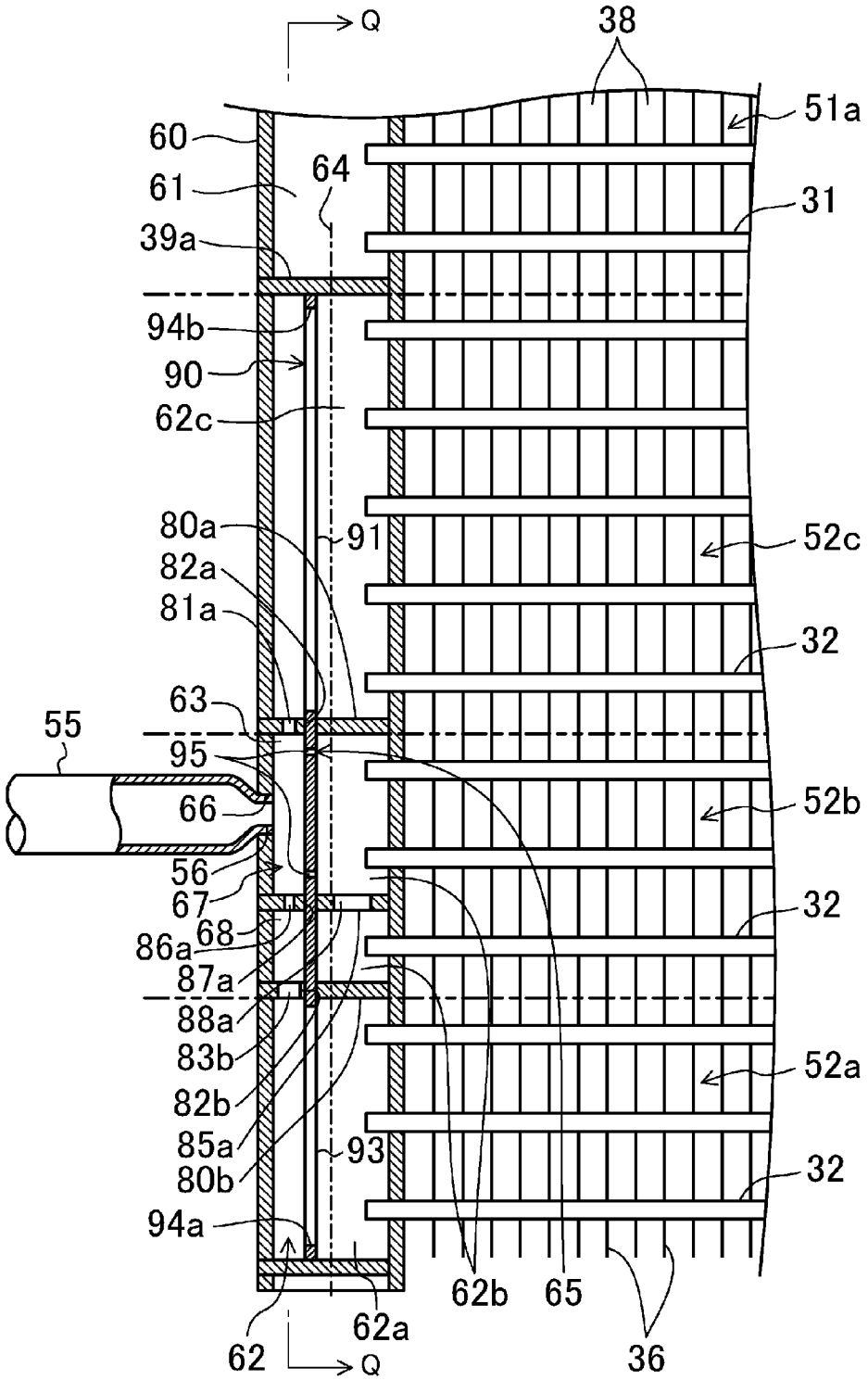
FIG. 8 is a cross-sectional view illustrating, on a larger scale, the front side of a main part of an outdoor heat exchanger according to a variation of the first embodiment.

The first header collecting pipe (60) illustrated in FIG. 5 has the mixing chamber (63) in a lower portion of the space between the first main horizontal partition plate (80*a*) and the second main horizontal partition plate (80*b*). However, as illustrated in FIG. 8, the mixing chamber (63) may also be defined in an upper portion of the space between the first main horizontal partition plate (80*a*) and the second main horizontal partition plate (80*b*). The following description will be focused on the difference in structure between the first header collecting pipe (60) of the present variation and the first header collecting pipe (60) illustrated in FIG. 5.

The first main horizontal partition plate (80*a*) of the present variation is positioned at the boundary between the second auxiliary heat exchange portion (52*b*) and the third auxiliary heat exchange portion (52*c*). The first main horizontal partition plate (80*a*) separates the second communication chamber (62*b*) and the third communication chamber (62*c*) from each other.

The second main horizontal partition plate (80*b*) of the present variation is positioned at the boundary between the first auxiliary heat exchange portion (52*a*) and the second auxiliary heat exchange portion (52*b*). The second main horizontal partition plate (80*b*) separates the first communication chamber (62*a*) and the second communication chamber (62*b*) from each other.

The auxiliary horizontal partition plate (85*a*) of the present variation is positioned between the first and second lowermost ones of the three flat tubes (32) which constitute the second auxiliary heat exchange portion (52*b*). In the present variation, a portion of the rear space (67) in the first header collecting pipe (60) over the auxiliary horizontal partition plate (85*a*) serves as the mixing chamber (63), and a portion thereof under the auxiliary horizontal partition plate (85*a*) serves as the intermediate chamber (68).

The connection port (66) of the present variation is cut through a region of the first header collecting pipe (60) between the auxiliary horizontal partition plate (85*a*) and the first main horizontal partition plate (80*a*), and communicates with the mixing chamber (63).

The vertical partition plate (90) of the present variation is provided with two flow rate adjusting holes (95) in a region of the middle portion (92) between the auxiliary horizontal partition plate (85*a*) and the first main horizontal partition plate (80*a*) (i.e., a region facing the mixing chamber (63)). These flow rate adjusting holes (95) allow the mixing chamber (63) to communicate with the second communication chamber (62*b*).

The first main horizontal partition plate (80*a*) of the present variation is a member having the same shape as the first main horizontal partition plate (80*a*) illustrated in FIG. 6D. The first main horizontal partition plate (80*a*) of the present variation is provided with a flow rate adjusting hole (81*a*). The flow rate adjusting hole (81*a*) allows the mixing chamber (63) to communicate with the third communication chamber (62*c*).

The second main horizontal partition plate (80*b*) of the present variation is a member having the same shape as the second main horizontal partition plate (80*b*) illustrated in FIG. 6B. The second main horizontal partition plate (80*b*) of the present variation is provided with three connecting holes (83*b*). These connecting holes (83*b*) allow the intermediate chamber (68) to communicate with the first communication chamber (62*a*).

The auxiliary horizontal partition plate (85*a*) of the present variation is a member having the same shape as the auxiliary horizontal partition plate (85*a*) illustrated in FIG. 6C. The auxiliary horizontal partition plate (85*a*) of the present variation is provided with one flow rate adjusting hole (86*a*) and three connecting holes (88*a*). The flow rate adjusting hole (86*a*) of the present variation allows the mixing chamber (63) to communicate with the intermediate chamber (68). The connecting holes (88*a*) of the present variation allow the upper and lower portions of the second communication chamber (62*b*) located over and under the auxiliary horizontal partition plate (85*a*) to communicate with each other.

Second Embodiment of the Invention

A second embodiment of the present invention will be described. The following description will be focused on the difference between an outdoor heat exchanger (23) according to the present embodiment and the outdoor heat exchanger (23) of the first embodiment.

<Configuration of Outdoor Heat Exchanger>

Figure 9:
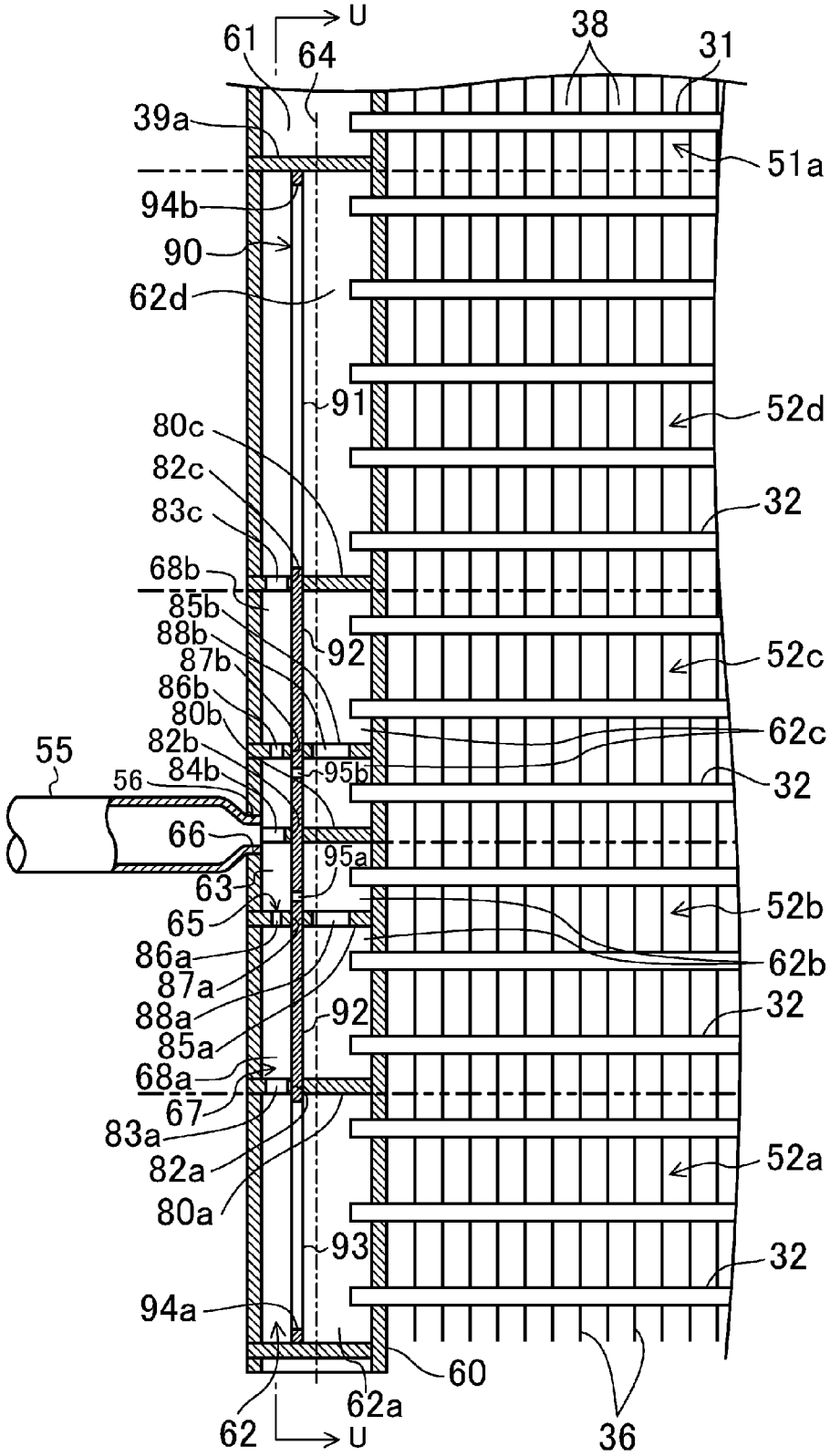
FIG. 9 is a cross-sectional view illustrating, on a larger scale, the front side of a main part of an outdoor heat exchanger according to a second embodiment.

As illustrated in FIG. 9, the outdoor heat exchanger (23) of the present embodiment is configured such that the auxiliary heat exchange region (52) is divided into four auxiliary heat exchange portions (52*a*-52*d*). The auxiliary heat exchange region (52) includes a first auxiliary heat exchange portion (52*a*), a second auxiliary heat exchange portion (52*b*), a third auxiliary heat exchange portion (52*c*), and a fourth auxiliary heat exchange portion (52*d*), which are arranged in this order from bottom to top. Although not shown, the main heat exchange region (51) of the outdoor heat exchanger (23) of the present embodiment is also divided into four main heat exchange portions.

Similarly to the outdoor heat exchanger (23) of the first embodiment, the auxiliary heat exchange portions (52*a*-52*d*) of the outdoor heat exchanger (23) of the present embodiment are associated one to one with the main heat exchange portions. In the outdoor heat exchanger (23) of the present embodiment, each of the auxiliary heat exchange portions (52*a*-52*d*) is connected in series to an associated one of the main heat exchange portions.

In the outdoor heat exchanger (23) of the present embodiment, the number of flat tubes (32) which constitute the first auxiliary heat exchange portion (52*a*) is three; the number of flat tubes (32) which constitute the second auxiliary heat exchange portion (52*b*) is three; the number of flat tubes (32) which constitute the third auxiliary heat exchange portion (52*c*) is three; and the number of flat tubes (32) which constitute the fourth auxiliary heat exchange portion (52*d*) is five.

<Configuration of Lower Portion of First Header Collecting Pipe>

The structure of a lower portion of the first header collecting pipe (60) of the present embodiment will be described in detail with reference to FIGS. 9-11 as appropriate. In the following description, a side surface of the first header collecting pipe (60) which faces the flat tubes (32) will be hereinafter referred to as a "front surface," and another side surface of the first header collecting pipe (60) which faces away from the flat tubes (32) will be hereinafter referred to as a "rear surface."

As illustrated in FIG. 9, three main horizontal partition plates (80*a*-80*c*), two auxiliary horizontal partition plates (85*a*, 85*b*), and one vertical partition plate (90) are arranged in the lower space (62) of the first header collecting pipe (60). The lower space (62) is partitioned into four communication chambers (62*a*-62*d*) and one mixing chamber (63) by the main horizontal partition plates (80*a*-80*c*), the auxiliary horizontal partition plates (85*a*, 85*b*), and the vertical partition plate (90). The main horizontal partition plates (80*a*-80*c*), the auxiliary horizontal partition plates (85*a*, 85*b*), and the vertical partition plate (90) are made of an aluminum alloy.

Each of the three main horizontal partition plates (80*a*-80*c*) and two auxiliary horizontal partition plates (85*a*, 85*b*) is a member in an approximately disk-like shape, and is arranged to cross horizontally the lower space (62). That is, the main horizontal partition plates (80*a*-80*c*) and the auxiliary horizontal partition plates (85*a*, 85*b*) partition the lower space (62) into spaces one above the other. The main horizontal partition plates (80*a*-80*c*) and the auxiliary horizontal partition plates (85*a*, 85*b*) are connected to the first header collecting pipe (60) by brazing.

The first main horizontal partition plate (80*a*) is arranged at the boundary between the first auxiliary heat exchange portion (52*a*) and the second auxiliary heat exchange portion (52*b*), and separates the first communication chamber (62*a*) and the second communication chamber (62*b*) from each other. The second main horizontal partition plate (80*b*) is arranged at the boundary between the second auxiliary heat exchange portion (52*b*) and the third auxiliary heat exchange portion (52*c*), and separates the second communication chamber (62*b*) and the third communication chamber (62*c*) from each other. The third main horizontal partition plate (80*c*) is arranged at the boundary between the third auxiliary heat exchange portion (52*c*) and the fourth auxiliary heat exchange portion (52*d*), and separates the third communication chamber (62*c*) and the fourth communication chamber (62*d*) from each other.

The first auxiliary horizontal partition plate (85*a*) is arranged between the first main horizontal partition plate (80*a*) and the second main horizontal partition plate (80*b*). The first auxiliary horizontal partition plate (85*a*) is arranged between the second and third lowermost ones of the three flat tubes (32) which constitute the second auxiliary heat exchange portion (52*b*). The second auxiliary horizontal partition plate (85*b*) is arranged between the second main horizontal partition plate (80*b*) and the third main horizontal partition plate (80*c*). The second auxiliary horizontal partition plate (85*b*) is arranged between the first and second lowermost ones of the three flat tubes (32) which constitute the third auxiliary heat exchange portion (52*c*).

The three main horizontal partition plates (80*a*-80*c*) and two auxiliary horizontal partition plates (85*a*, 85*b*) are each provided with a slit hole (82*a*, 82*b*, 82*c*, 87*a*, 87*b*). As illustrated in FIG. 11, the slit holes (82*a*-82*c*, 87*a*, 87*b*) each have an elongated rectangular shape, and pass through the horizontal partition plates (80*a*-80*c*, 85*a*, 85*b*) in the thickness direction. The longer sides of the slit holes (82*a*-82*c*, 87*a*, 87*b*) are substantially parallel to the end faces of the flat tubes (32).

In the three main horizontal partition plates (80*a*-80*c*) and two auxiliary horizontal partition plates (85*a*, 85*b*), the slit holes (82*a*-82*c*, 87*a*, 87*b*) are located closer to the rear surface of the first header collecting pipe (60) than the central axis (64) of the first header collecting pipe (60) is (see FIG. 11). The slit holes (82*a*-82*c*, 87*a*, 87*b*) each have a width that is almost equal to the thickness of the vertical partition plate (90), and a length that is almost equal to the width of the vertical partition plate (90).

Figure 11A:
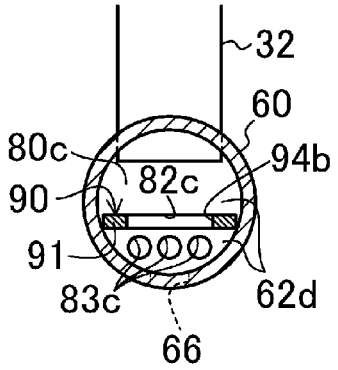
FIGS. 11A to 11E are cross-sectional views illustrating a main part of the outdoor heat exchanger of the second embodiment.
Figure 11D:
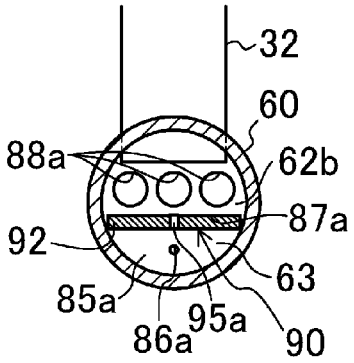
Figure 11B:
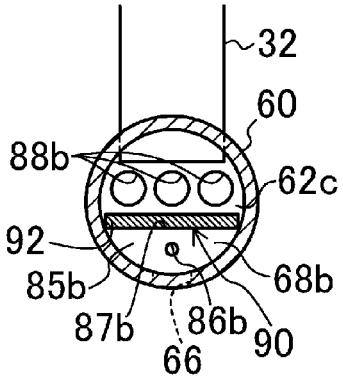
Figure 11E:
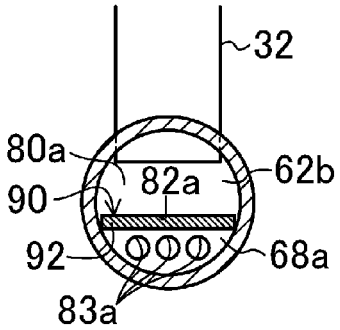

As illustrated in FIG. 11E, the first main horizontal partition plate (80*a*) has three connecting holes (83*a*). Each of the connecting holes (83*a*) is a circular hole which passes through the first main horizontal partition plate (80*a*) in the thickness direction. The three connecting holes (83*a*) are arranged closer to the rear surface of the first header collecting pipe (60) than the slit hole (82*a*) is.

Figure 11C:
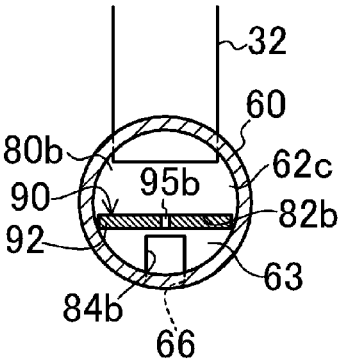

As illustrated in FIG. 11C, the second main horizontal partition plate (80*b*) has a cutout hole (84*b*). The cutout hole (84*b*) is a rectangular cutout extending from the outer periphery toward the center of the second main horizontal partition plate (80*b*). The cutout hole (84*b*) is arranged closer to the rear surface of the first header collecting pipe (60) than the slit hole (82*b*) is. Further, the width of the cutout hole (84*b*) in the transverse direction of FIG. 11C is substantially equal to the diameter of the connection port (66).

As illustrated in FIG. 11A, the third main horizontal partition plate (80*c*) has three connecting holes (83*c*). Each of the connecting holes (83*c*) is a circular hole which passes through the third main horizontal partition plate (80*c*) in the thickness direction. The three connecting holes (83*c*) are arranged closer to the rear surface of the first header collecting pipe (60) than the slit hole (82*c*) is.

As illustrated in FIGS. 11B and 11D, the first auxiliary horizontal partition plate (85*a*) and the second auxiliary horizontal partition plate (85*b*) each have one flow rate adjusting hole (86*a*, 86*b*) and three connecting holes (88*a*, 88*b*). Each of the flow rate adjusting holes (86*a*, 86*b*) and connecting holes (88*a*, 86*b*) is a circular hole which passes through the auxiliary horizontal partition plate (85*a*, 85*b*) in the thickness direction. The flow rate adjusting hole (86*a*, 86*b*) is arranged closer to the rear surface of the first header collecting pipe (60) than the slit hole (87*a*, 87*b*) is. The three connecting holes (88*a*, 88*b*) are arranged closer to the front surface of the first header collecting pipe (60) than the slit hole (87*a*, 87*b*) is.

Figure 12:
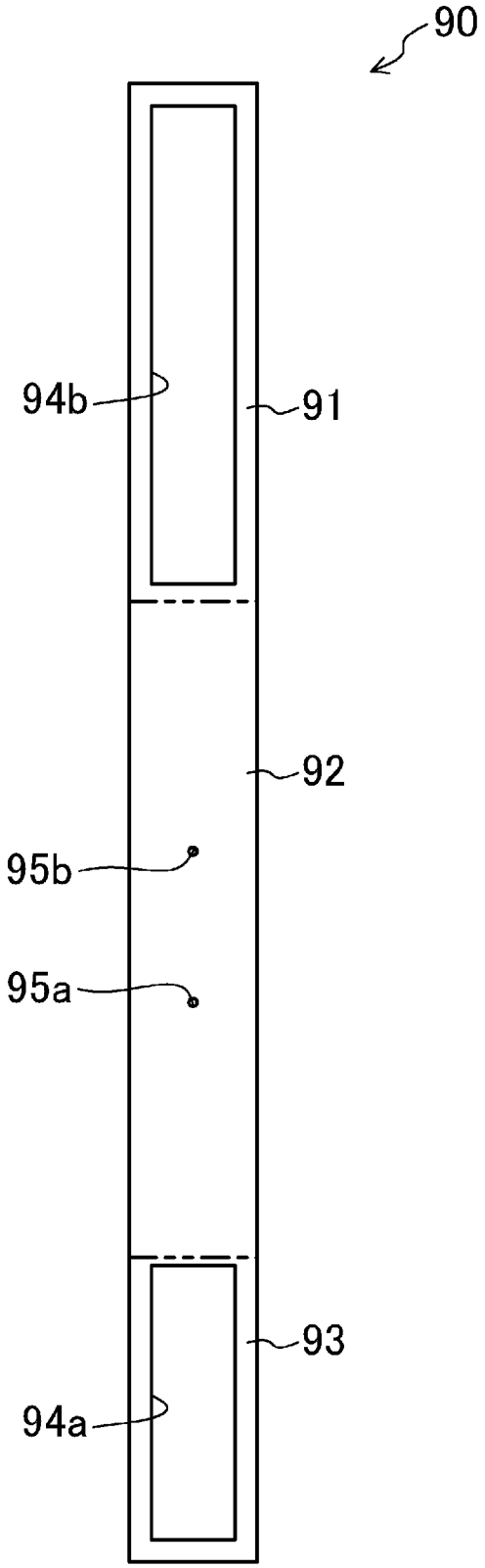
FIG. 12 is a plan view of a vertical partition plate provided for the outdoor heat exchanger of the second embodiment.

The vertical partition plate (90) is in an elongated rectangular plate-like shape, as in the first embodiment (see FIG. 12). The vertical partition plate (90) passes through the slit holes (82*a*-82*c*) of the main horizontal partition plates (80*a*-80*c*) and the slit holes (87*a*, 87*b*) of the auxiliary horizontal partition plates (85*a*, 85*b*) (see FIGS. 9 and 11). Similarly to the first embodiment, the vertical partition plate (90) vertically runs through the lower space (62) of the first header collecting pipe (60), and faces the respective end faces of the flat tubes (32) inserted in the first header collecting pipe (60).

Figure 10:
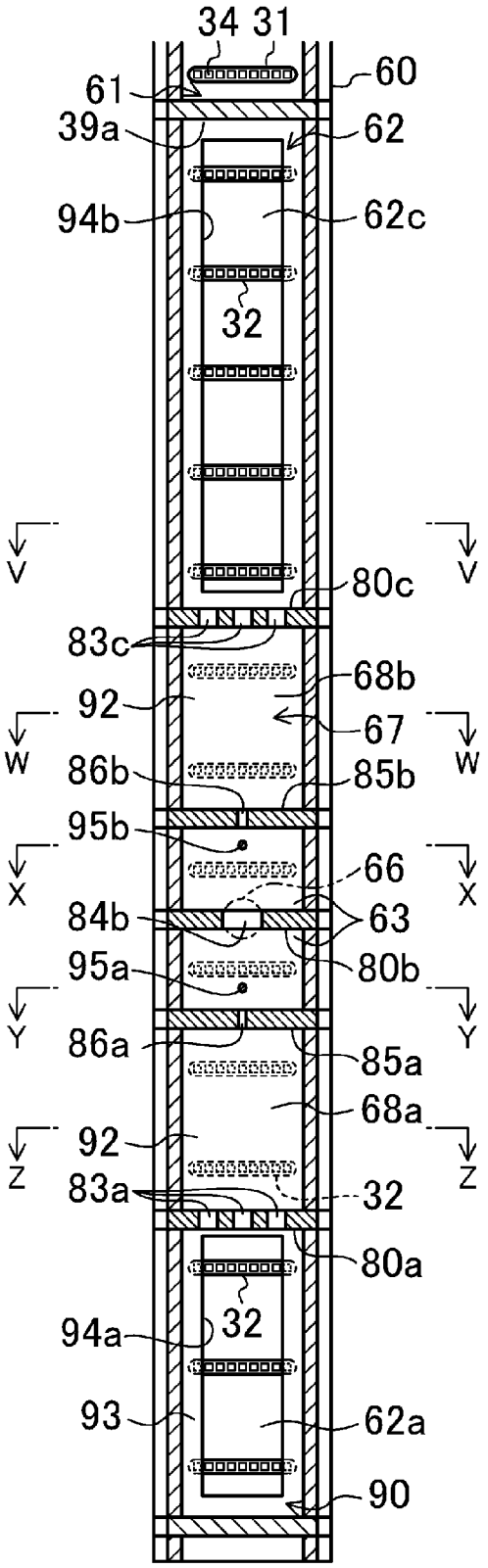
FIG. 10 is a cross-sectional view illustrating a part of a cross section taken along the plane U-U of FIG. 9.

The vertical partition plate (90) includes an upper portion (91) located over the third main horizontal partition plate (80*c*), a middle portion (92) located between the third main horizontal partition plate (80*c*) and the first main horizontal partition plate (80*a*), and a lower portion (93) located under the first main horizontal partition plate (80*a*) (see FIGS. 9 and 10).

The middle portion (92) of the vertical partition plate (90) partitions a portion of the lower space (62) which is sandwiched between the third main horizontal partition plate (80*c*) and the first main horizontal partition plate (80*a*), into two spaces located closer to the front and rear surfaces of the first header collecting pipe (60). The space located closer to the front surface of the first header collecting pipe (60) with respect to the middle portion (92) of the vertical partition plate (90) is partitioned into the second communication chamber (62*b*) and the third communication chamber (62*c*) by the second main horizontal partition plate (80*b*). The space located closer to the rear surface of the first header collecting pipe (60) with respect to the middle portion (92) of the vertical partition plate (90) is a rear space (67).

The rear space (67) is partitioned by the two auxiliary horizontal partition plates (85*a*, 85*b*) into spaces arranged one above the other. A lower portion of the rear space (67) located under the first auxiliary horizontal partition plate (85*a*) defines a first intermediate chamber (68*a*), and an upper portion of the rear space (67) located over the second auxiliary horizontal partition plate (85*b*) defines a second intermediate chamber (68*b*), and an intermediate portion of the rear space (67) located between the first auxiliary horizontal partition plate (85*a*) and the second auxiliary horizontal partition plate (85*b*) defines a mixing chamber (63). That is, the two auxiliary horizontal partition plates (85*a*, 85*b*) partition the rear space (67) into one mixing chamber (63) and two intermediate chambers (68*a*, 68*b*).

Thus, the mixing chamber (63) is surrounded by the middle portion (92) of the vertical partition plate (90), the first auxiliary horizontal partition plate (85*a*), the second auxiliary horizontal partition plate (85*b*), and the sidewall portion of the first header collecting pipe (60). That is, in the first header collecting pipe (60), the mixing chamber (63) lies next to the second communication chamber (62*b*) and the third communication chamber (62*c*) with the middle portion (92) of the vertical partition plate (90) interposed between those chambers (63, 62*b*).

Further, the first auxiliary horizontal partition plate (85*a*) is disposed between the first main horizontal partition plate (80*a*) and the second main horizontal partition plate (80*b*), and is closer to the second main horizontal partition plate (80*b*) than to the first main horizontal partition plate (80*a*). The second auxiliary horizontal partition plate (85*b*) is disposed between the second main horizontal partition plate (80*b*) and the third main horizontal partition plate (80*c*), and is closer to the second main horizontal partition plate (80*b*) than to the third main horizontal partition plate (80*c*). Thus, the height of the mixing chamber (63) between the two auxiliary horizontal partition plates (85*a*, 85*b*) is shorter than the heights of the second communication chamber (62*b*) and third communication chamber (62*c*).

The vertical partition plate (90) is provided with two rectangular openings (94*a*, 94*b*) and two circular flow rate adjusting holes (95*a*, 95*b*). Each of the openings (94*a*, 94*b*) and the flow rate adjusting holes (95*a*, 95*b*) passes through the vertical partition plate (90) in its thickness direction.

The openings (94*b*, 94*a*) are respectively cut through the upper portion (91) and lower portion (93) of the vertical partition plate (90). The upper opening (94*b*) forms a large area of the upper portion (91) of the vertical partition plate (90). Thus, in the fourth communication chamber (62*d*) located over the third main horizontal partition plate (80*c*), the spaces on both sides of the vertical partition plate (90) constitute substantially a single space. The lower opening (94*a*) forms a large area of the lower portion (93) of the vertical partition plate (90). Thus, in the first communication chamber (62*a*) located under the first main horizontal partition plate (80*a*), the spaces on both sides of the vertical partition plate (90) constitute substantially a single space.

Both of the two flow rate adjusting holes (95*a*, 95*b*) are circular holes which pass through the vertical partition plate (90) in its thickness direction. The first flow rate adjusting hole (95*a*) is cut through a region of the middle portion (92) of the vertical partition plate (90) so as to be located between the second main horizontal partition plate (80*b*) and the first auxiliary horizontal partition plate (85*a*). The second flow rate adjusting hole (95*b*) is cut through a region of the middle portion (92) of the vertical partition plate (90) so as to be located between the second main horizontal partition plate (80*b*) and the second auxiliary horizontal partition plate (85*b*). Further, the two flow rate adjusting holes (95*a*, 95*b*) are arranged one above the other along a center line of the width dimension of the vertical partition plate (90).

Similarly to the first embodiment, a sidewall portion of the first header collecting pipe (60) is provided with a connection port (66). The connection port (66) is level with the second main horizontal partition plate (80*b*), and communicates with the mixing chamber (63). The connection port (66) is arranged so that its center is located at the middle of the vertical dimension of the mixing chamber (63).

The flow rate adjusting holes (95*a*, 95*b*) of the vertical partition plate (90) are arranged respectively near the upper and lower ends of the vertical partition plate (90) facing the mixing chamber (63). On the other hand, the center of the connection port (66) is located at the middle of the vertical dimension of the mixing chamber (63). That is, the flow rate adjusting holes (95*a*, 95*b*) of the vertical partition plate (90) are arranged so as not to face the connection port (66).

As described above, the first auxiliary horizontal partition plate (85*a*), the second auxiliary horizontal partition plate (85*b*), and the vertical partition plate (90) are provided with the flow rate adjusting holes (86*a*, 86*b*, 95*a*, 95*b*). These flow rate adjusting holes (86*a*, 86*b*, 95*a*, 95*b*) are communication through holes for distributing the refrigerant in the mixing chamber (63) to the respective communication chambers (62*a*-62*d*) at a predetermined ratio. These flow rate adjusting holes (86*a*, 86*b*, 95*a*, 95*b*) constitute a distribution passage (65) for distributing the refrigerant in the mixing chamber (63) to the respective communication chambers (62*a*-62*d*) at a predetermined ratio.

The flow rate adjusting hole (86*a*) of the first auxiliary horizontal partition plate (85*a*) allows the mixing chamber (63) to communicate with the first communication chamber (62*a*) via the first intermediate chamber (68*a*). The flow rate adjusting hole (86*a*) has a diameter of about 2 mm, for example.

The flow rate adjusting hole (86*b*) of the second auxiliary horizontal partition plate (85*b*) allows the mixing chamber (63) to communicate with the fourth communication chamber (62*d*) through the second intermediate chamber (68*b*). The flow rate adjusting hole (86*b*) has a slightly larger diameter than the flow rate adjusting hole (86*a*) of the first auxiliary horizontal partition plate (85*a*).

The first flow rate adjusting hole (95*a*) of the vertical partition plate (90) allows the mixing chamber (63) to communicate with the second communication chamber (62*b*). The diameter of the first flow rate adjusting hole (95*a*) is substantially equal to that of the flow rate adjusting hole (86*a*) of the first auxiliary horizontal partition plate (85*a*).

The second flow rate adjusting hole (95*b*) of the vertical partition plate (90) allows the mixing chamber (63) to communicate with the third communication chamber (62*c*). The diameter of the second flow rate adjusting hole (95*b*) is substantially equal to that of the flow rate adjusting hole (86*a*) of the first auxiliary horizontal partition plate (85*a*).

Further, as described above, the first main horizontal partition plate (80*a*) is provided with three connecting holes (83*a*). The connecting holes (83*a*) of the first main horizontal partition plate (80*a*) allow the first intermediate chamber (68*a*) to communicate with the first communication chamber (62*a*). Each of the connecting holes (83*a*) has a much larger diameter than the flow rate adjusting hole (86*a*) of the first auxiliary horizontal partition plate (85*a*). The sum of the respective cross-sectional areas of these three connecting holes (83*a*) is sufficiently greater than (e.g., ten times or more as large as) the cross-sectional area of the flow rate adjusting hole (86*a*) of the first auxiliary horizontal partition plate (85*a*). This means that the first intermediate chamber (68*a*) communicates with the first communication chamber (62*a*) through the connecting holes (83*a*), each having a large cross-sectional area, and therefore, the first intermediate chamber (68*a*) and the first communication chamber (62*a*) form substantially a single space.

Further, as described above, the third main horizontal partition plate (80*c*) is provided with three connecting holes (83*c*). These connecting holes (83*c*) of the third main horizontal partition plate (80*c*) allow the second intermediate chamber (68*b*) to communicate with the fourth communication chamber (62*d*). Each of the connecting holes (83*c*) has a much larger diameter than the flow rate adjusting hole (86*b*) of the second auxiliary horizontal partition plate (85*b*). The sum of the respective cross-sectional areas of these three connecting holes (83*c*) is sufficiently greater than (e.g., ten times or more as large as) the cross-sectional area of the flow rate adjusting hole (86*b*) of the second auxiliary horizontal partition plate (85*b*). This means that the second intermediate chamber (68*b*) communicates with the fourth communication chamber (62*d*) through the connecting holes (83*c*), each having a large cross-sectional area, and therefore, the second intermediate chamber (68*b*) and the fourth communication chamber (62*d*) form substantially a single space.

Further, as described above, the first auxiliary horizontal partition plate (85*a*) is disposed between the first main horizontal partition plate (80*a*) and the second main horizontal partition plate (80*b*). That is, the first auxiliary horizontal partition plate (85*a*) horizontally crosses the second communication chamber (62*b*). On the other hand, the first auxiliary horizontal partition plate (85*a*) is provided with three connecting holes (88*a*). Thus, portions of the second communication chamber (62*b*) located over and under the first auxiliary horizontal partition plate (85*a*) communicate with each other through the connecting holes (88*a*).

Each of the connecting holes (88*a*) of the first auxiliary horizontal partition plate (85*a*) has a much larger diameter than the first flow rate adjusting hole (95*a*) of the vertical partition plate (90). The sum of the respective cross-sectional areas of these three connecting holes (88*a*) is sufficiently greater than (e.g., ten times or more as large as) the cross-sectional area of the first flow rate adjusting hole (95*a*). This means that the second communication chamber (62*b*) is substantially a single space, although the first auxiliary horizontal partition plate (85*a*) is arranged so as to horizontally cross the second communication chamber (62*b*).

Further, as described above, the second auxiliary horizontal partition plate (85*b*) is disposed between the second main horizontal partition plate (80*b*) and the third main horizontal partition plate (80*c*). That is, the second auxiliary horizontal partition plate (85*b*) horizontally crosses the third communication chamber (62*c*). On the other hand, the second auxiliary horizontal partition plate (85*b*) is provided with three connecting holes (88*b*). Thus, portions of the third communication chamber (62*c*) located over and under the second auxiliary horizontal partition plate (85*b*) communicate with each other through the connecting holes (88*b*).

Each of the connecting holes (88*b*) of the second auxiliary horizontal partition plate (85*b*) has a much larger diameter than the second flow rate adjusting hole (95*b*) of the vertical partition plate (90). The sum of the respective cross-sectional areas of these three connecting holes (88*b*) is sufficiently greater than (e.g., ten times or more as large as) the cross-sectional area of the second flow rate adjusting hole (95*b*) of the vertical partition plate (90). This means that the third communication chamber (62*c*) is substantially a single space, although the second auxiliary horizontal partition plate (85*b*) is arranged so as to horizontally cross the third communication chamber (62*c*).

<Refrigerant Flow in Outdoor Heat Exchanger>

Similarly to the first embodiment, a gas-liquid two-phase refrigerant is supplied to the outdoor heat exchanger (23) which functions as an evaporator. The gas-liquid two-phase refrigerant supplied to the outdoor heat exchanger (23) of the present embodiment is distributed to the four auxiliary heat exchange portions (52*a*-52*d*). Flow of the refrigerant supplied to the outdoor heat exchanger (23) of the present embodiment functioning as an evaporator will be described below.

The gas-liquid two-phase refrigerant to be supplied to the outdoor heat exchanger (23) functioning as an evaporator passes through the liquid-side connecting pipe (55) and flows into the mixing chamber (63) in the first header collecting pipe (60). In the mixing chamber (63), the refrigerant ejected at a high flow velocity from the liquid-side connecting pipe (55) collides against the vertical partition plate (90), and the gas refrigerant and liquid refrigerant in this refrigerant are mixed together. That is, the refrigerant in the mixing chamber (63) is homogenized, thereby making the refrigerant in the mixing chamber (63) have approximately a uniform wetness.

The refrigerant in the mixing chamber (63) is distributed to the respective communication chambers (62*a*-62*d*). As described above, the gas-liquid two-phase refrigerant in the mixing chamber (63) has been homogenized. Thus, the refrigerant having approximately an equal wetness flows into the respective communication chambers (62*a*-62*d*) from the mixing chamber (63).

The refrigerant in the mixing chamber (63) passes through the flow rate adjusting hole (86*a*) of the first auxiliary horizontal partition plate (85*a*), and temporarily flows into the first intermediate chamber (68*a*), and then passes through the connecting holes (83*a*) of the first main horizontal partition plate (80*a*) and flows into the first communication chamber (62*a*).

Further, the refrigerant in the mixing chamber (63) passes through the first flow rate adjusting hole (95*a*) of the vertical partition plate (90), and flows into the upper portion of the second communication chamber (62*b*) over the first auxiliary horizontal partition plate (85*a*). Part of the refrigerant which has flowed into the upper portion of the second communication chamber (62*b*) over the first auxiliary horizontal partition plate (85*a*) passes through the connecting holes (88*a*) of the first auxiliary horizontal partition plate (85*a*), and flows into the lower portion of the second communication chamber (62*b*) under the first auxiliary horizontal partition plate (85*a*). That is, the refrigerant which has passed through the first flow rate adjusting hole (95*a*) of the vertical partition plate (90) spreads across the entire second communication chamber (62*b*).

Further, the refrigerant in the mixing chamber (63) passes through the second flow rate adjusting hole (95*b*) of the vertical partition plate (90), and flows into the lower portion of the third communication chamber (62*c*) under the second auxiliary horizontal partition plate (85*b*). Part of the refrigerant which has flowed into the lower portion of the third communication chamber (62*c*) under the second auxiliary horizontal partition plate (85*b*) passes through the connecting holes (88*b*) of the second auxiliary horizontal partition plate (85*b*), and flows into the upper portion of the third communication chamber (62*c*) over the second auxiliary horizontal partition plate (85*b*). That is, the refrigerant which has passed through the second flow rate adjusting hole (95*b*) of the vertical partition plate (90) spreads across the entire third communication chamber (62*c*).

Further, the refrigerant in the mixing chamber (63) passes through the flow rate adjusting hole (86*b*) of the second auxiliary horizontal partition plate (85*b*), and temporarily flows into the second intermediate chamber (68*b*), and then passes through the connecting holes (83*c*) of the third main horizontal partition plate (80*c*) and flows into the fourth communication chamber (62*d*).

In the outdoor heat exchanger (23) of the present embodiment, the sizes of the flow rate adjusting holes (86*a*, 86*b*, 95*a*, 95*b*) which constitute the distribution passage (65) are determined such that the refrigerant is distributed from the mixing chamber (63) to the communication chambers (62*a*-62*d*) at a predetermined ratio. Specifically, in the outdoor heat exchanger (23) of the present embodiment, the distribution ratio of the refrigerant from the mixing chamber (63) to the communication chambers (62*a*-62*d*) is set such that the refrigerant flows, at substantially equal mass flow rates, into the respective flat tubes (32) that constitute the auxiliary heat exchange portions (52*a*-52*d*).

Thus, in the outdoor heat exchanger (23) of the present embodiment, the mass flow rate of the refrigerant flowing into the first communication chamber (62*a*) from the mixing chamber (63), the mass flow rate of the refrigerant flowing into the second communication chamber (62*b*) from the mixing chamber (63), and the mass flow rate of the refrigerant flowing into the third communication chamber (62*c*) from the mixing chamber (63) are substantially equal to each other. Also, the mass flow rate of the refrigerant flowing into the fourth communication chamber (62*d*) from the mixing chamber (63) is greater than that of the refrigerant flowing into the first communication chamber (62*a*) from the mixing chamber (63).

The refrigerant which has flowed into the respective communication chambers (62*a*-62*d*) of the first header collecting pipe (60) is distributed to the flat tubes (32) of auxiliary heat exchange portion (52*a*-52*d*) associated with the communication chambers (62*a*-62*d*). After that, the refrigerant passes through the auxiliary heat exchange portions (52*a*-52*d*) and then the main heat exchange portions associated with the auxiliary heat exchange portions (52*a*-52*d*), and turns into a gas refrigerant in substantially a single phase and flows out of the outdoor heat exchanger (23).

—Advantages of Second Embodiment—

The present embodiment provides the same advantages as the first embodiment. That is, in the outdoor heat exchanger (23) of the present embodiment, the mixing chamber (63) is defined by the two auxiliary horizontal partition plates (85*a*, 85*b*) and the vertical partition plate (90) provided in the first header collecting pipe (60). The gas-liquid two-phase refrigerant which has flowed into the mixing chamber (63) collides against the vertical partition plate (90), and is thereby agitated. Thus, the present embodiment allows for equalizing the wetness of a refrigerant to be distributed to the respective communication chambers (62*a*-62*d*) from the mixing chamber (63), and therefore, also equalizing the wetness of the refrigerant to flow into the flat tubes (32) that communicate with the communication chambers (62*a*-62*d*).

Moreover, in the first header collecting pipe (60) of the present embodiment, the mixing chamber (63) is defined between the two auxiliary horizontal partition plates (85*a*, 85*b*), and the height of this mixing chamber (63) is shorter than the heights of the second communication chamber (62*b*) and the third communication chamber (62*c*). The mixing chamber (63) of the present embodiment with such a reduced height allows for reliable homogenization of the gas-liquid two-phase refrigerant in the mixing chamber (63), even if four communication chambers (62*a*-62*d*) are defined in the first header collecting pipe (60) by the three main horizontal partition plates (80*a*-80*c*).

Other Embodiments

First Variation

As described above, in the outdoor heat exchanger (23) of the first embodiment, each of the second main horizontal partition plate (80*b*) and the auxiliary horizontal partition plate (85*a*) is provided with three circular connecting holes (83*b*, 88*a*) (see FIGS. 6B and 6C). Further, in the outdoor heat exchanger (23) of the second embodiment, each of the first main horizontal partition plate (80*a*), the third main horizontal partition plate (80*c*), the first auxiliary horizontal partition plate (85*a*), and the second auxiliary horizontal partition plate (85*b*) is provided with three circular connecting holes (83*a*, 83*c*, 88*a*, 88*b*) (see FIGS. 11A, 11B, 11D and 11E).

Figure 13A:
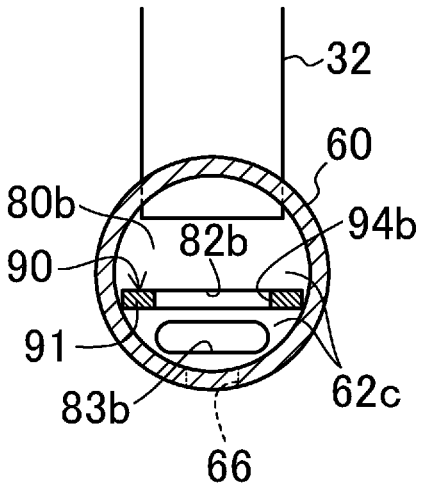
FIGS. 13A and 13B are cross-sectional views illustrating a main part of the outdoor heat exchanger of the first embodiment to which a first variation of another embodiment is applied.
Figure 13B:
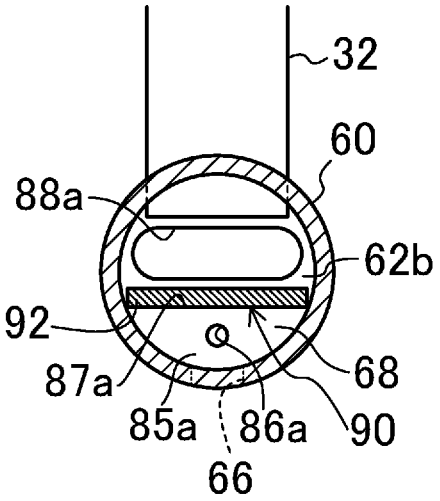

However, the shape and the number of these connecting holes (83*a*-83*c*, 88*a*, 88*b*) of the horizontal partition plates (80*a*-80*c*, 85*a*, 85*b*) are merely an example. The shape and the number of these connecting holes (83*a*-83*c*, 88*a*, 88*b*) of the horizontal partition plates (80*a*-80*c*, 85*a*, 85*b*) just need to be determined so that these connecting holes (83*a*-83*c*, 88*a*, 88*b*) are through holes having sufficiently larger cross-sectional areas than the flow rate adjusting holes (81*a*, 86*a*, 86*b*, 95, 95*a*, 95*b*). For example, as illustrated in FIG. 13, each of the second main horizontal partition plate (80*b*) and auxiliary horizontal partition plate (85*a*) in the first embodiment may be provided with an oblong connecting hole (83*b*, 88*a*).

Second Variation

As described above, in the outdoor heat exchangers (23) of the above embodiments, the areas of openings of the flow rate adjusting holes (81*a*, 86*a*, 86*b*, 95, 95*a*, 95*b*) are determined such that the refrigerant flows, at substantially equal mass flow rates, into the respective flat tubes (32) that constitute the auxiliary heat exchange portions (52*a*-52*d*). However, the refrigerant does not have to flow, at a uniform mass flow rate, into all of the flat tubes (32) that constitute the auxiliary heat exchange portions (52*a*-52*d*).

That is, for example, the areas of openings of the flow rate adjusting holes (81*a*, 95, 86*a*, 95*a*) may be determined such that the refrigerant flows at a greater mass flow rate into the first communication chamber (62*a*) from the mixing chamber (63) than into the second communication chamber (62*b*) from the mixing chamber (63) in the outdoor heat exchangers (23) of the above embodiments. In the outdoor heat exchangers (23) of the above embodiments, each of the first communication chamber (62*a*) and the second communication chamber (62*b*) is provided with three flat tubes (32). Thus, in this case, the refrigerant flows at a greater mass flow rate into the flat tubes (32) that communicate with the first communication chamber (62*a*) than into the flat tubes (32) that communicate with the second communication chamber (62*b*).

Third Variation

The outdoor heat exchangers (23) of the embodiments described above may be provided with wavy fins, instead of the plate-like fins (36) described above. Such fins are so-called "corrugated fins," which have a vertically meandering shape. These wavy fins are arranged such that one of those fins is interposed between each pair of vertically adjacent flat tubes (31, 32).

INDUSTRIAL APPLICABILITY

As can be seen from the foregoing description, the present invention is useful for a heat exchanger in which a plurality of flat tubes are connected to header collecting pipes.

DESCRIPTION OF REFERENCE CHARACTERS

10 air conditioner
11 outdoor unit
12 indoor unit

13 liquid-side communication pipe
14 gas-side communication pipe
15 outdoor fan
16 indoor fan
17 copper pipe
18 copper pipe
20 refrigerant circuit
21 compressor
22 four-way valve
23 outdoor heat exchanger
24 expansion valve
25 indoor heat exchanger
31 flat tube
32 flat tube
34 fluid passages
36 fin
38 ventilation passages
39*a*, 39*c*, 39*d* partition plates
40 louvers
45 narrow cutouts
46 pipe insertion portion
51 main heat exchange region
51*a* first main heat exchange portion
51*b* second main heat exchange portion
51*c* third main heat exchange portion
52 auxiliary heat exchange region
52*a* first auxiliary heat exchange portion
52*b* second auxiliary heat exchange portion
52*c* third auxiliary heat exchange portion
52*d* fourth auxiliary heat exchange portion
55 liquid-side connecting pipe
56 connecting end
57 gas-side connecting pipe
60 first header collecting pipe
61 upper space
62 lower space
62*a* first communication chamber
62*b* second communication chamber
62*c* third communication chamber
62*d* fourth communication chamber
63 mixing chamber
64 central axis
65 distribution passage
66 connection port
67 rear space
68 intermediate chamber
68*a* first intermediate chamber
70 second header collecting pipe
71 main communication space
71*a* first sub-space
71*b* second sub-space
71*c* third sub-space
72 auxiliary communication space
72*a* fourth sub-space
72*b* fifth sub-space
72*c* sixth sub-space
76 connecting pipes
77 connecting pipes
80*a* first main horizontal partition plate
80*b* second main horizontal partition plate
80*c* third main horizontal partition plate
81*a* flow rate adjusting hole (communication through hole)
82*a* slit hole
82*b* slit hole
83*b* connecting hole
83*c* connecting holes
84*b* cutout hole
85*a* first auxiliary horizontal partition plate, auxiliary horizontal partition plate
85*b* second auxiliary horizontal partition plate
86*a*, 86*b* flow rate adjusting hole (communication through hole)
87*a*, 87*b* slit hole
88*a*, 88*b* connecting holes
90 vertical partition plate
91 upper portion
92 middle portion
93 lower portion
94*a* rectangular openings
94*b* rectangular openings
95, 95*a*, 95*b* flow rate adjusting hole (communication through hole)

The invention claimed is:

1. A heat exchanger comprising:
a plurality of flat tubes;
a first header collecting pipe to which one end of each of the flat tubes is connected;
a second header collecting pipe to which the other end of each of the flat tubes is connected; and
a plurality of fins joined to the flat tubes,
the heat exchanger being capable of functioning as an evaporator by exchanging heat between a refrigerant flowing in the flat tubes and air, wherein
the first header collecting pipe and the second header collecting pipe stand upright,
the first header collecting pipe is provided with one connection port to which a pipe is connected to guide a gas-liquid two-phase refrigerant into the first header collecting pipe, and
the first header collecting pipe has
main horizontal partition plates that define a plurality of communication chambers, each communicating with one or more of the flat tubes, by horizontally crossing an internal space of the first header collecting pipe,
a vertical partition plate that defines a mixing chamber, communicating with the connection port and all of the communication chambers, by vertically running through the internal space of the first header collecting pipe, and
an auxiliary horizontal partition plate that defines, along with the vertical partition plate, the mixing chamber by being disposed between a pair of the main horizontal partition plates, which are vertically adjacent to each other, and by horizontally crossing the internal space of the first header collecting pipe, and
the mixing chamber is shorter in height than one of the plurality of communication chambers, which is adjacent to the mixing chamber, with the vertical partition plate interposed between the mixing chamber and the adjacent communication chamber.

2. The heat exchanger of claim 1, wherein
the vertical partition plate is arranged opposite the flat tubes with respect to a central axis of the first header collecting pipe.

3. The heat exchanger of claim 2, wherein
the mixing chamber is separated from the communication chambers by the vertical partition plate, one of the main horizontal partition plates which is arranged on one side of the mixing chamber, and the auxiliary horizontal partition plate arranged on the other side of the mixing chamber.

4. The heat exchanger of claim 3, wherein each of the vertical partition plate, the main horizontal partition plate, and the auxiliary horizontal partition plate which separate the mixing chamber from the communication chambers is provided with a communication through hole through which the refrigerant in the mixing chamber is distributed to the respective communication chambers at a predetermined ratio.

5. The heat exchanger of claim 2, wherein the mixing chamber is separated from the communication chambers by the vertical partition plate and a pair of auxiliary horizontal partition plates arranged one above the other with the mixing chamber interposed between themselves.

6. The heat exchanger of claim 5, wherein each of the pair of auxiliary horizontal partition plates and the vertical partition plate which separate the mixing chamber from the communication chambers is provided with a communication through hole through which the refrigerant in the mixing chamber is distributed to the respective communication chambers at a predetermined ratio.

7. The heat exchanger of claim 2, wherein the mixing chamber lies next to one or two of the communication chambers with the vertical partition plate interposed between the chambers.

8. The heat exchanger of claim 2, wherein the vertical partition plate is provided with a communication through hole through which the mixing chamber communicates with the communication chamber which lies next to the mixing chamber with the vertical partition plate interposed between the chambers.

9. The heat exchanger of claim 8, wherein the connection port is formed in a sidewall of the first header collecting pipe, and faces the vertical partition plate, and the communication through hole of the vertical partition plate is arranged so as not to face the connection port.

10. The heat exchanger of claim 2, wherein the heat exchanger is divided into a main heat exchange region and an auxiliary heat exchange region which each have at least two of the flat tubes, the auxiliary heat exchange region is arranged under the main heat exchange region, the auxiliary heat exchange region is divided into a plurality of auxiliary heat exchange portions, each of which has a plurality of flat tubes and is associated with one of the communication chambers, the flat tubes of the auxiliary heat exchange portions communicate with the communication chambers associated with the respective auxiliary heat exchange portions, the main heat exchange region is divided into a plurality of main heat exchange portions, each of which has a plurality of flat tubes and is associated with one of the auxiliary heat exchange portions, and the flat tubes of the main heat exchange portions communicate, through the second header collecting pipe, with the flat tubes of the auxiliary heat exchange portions associated with the main heat exchange portions.

11. The heat exchanger of claim 1, wherein the mixing chamber is separated from the communication chambers by the vertical partition plate, one of the main horizontal partition plates which is arranged on one side of the mixing chamber, and the auxiliary horizontal partition plate arranged on the other side of the mixing chamber.

12. The heat exchanger of claim 11, wherein each of the vertical partition plate, the main horizontal partition plate, and the auxiliary horizontal partition plate which separate the mixing chamber from the communication chambers is provided with a communication through hole through which the refrigerant in the mixing chamber is distributed to the respective communication chambers at a predetermined ratio.

13. The heat exchanger of claim 1, wherein the mixing chamber is separated from the communication chambers by the vertical partition plate and a pair of auxiliary horizontal partition plates arranged one above the other with the mixing chamber interposed between themselves.

14. The heat exchanger of claim 13, wherein each of the pair of auxiliary horizontal partition plates and the vertical partition plate which separate the mixing chamber from the communication chambers is provided with a communication through hole through which the refrigerant in the mixing chamber is distributed to the respective communication chambers at a predetermined ratio.

15. The heat exchanger of claim 1, wherein the mixing chamber lies next to one or two of the communication chambers with the vertical partition plate interposed between the chambers.

16. The heat exchanger of claim 1, wherein the vertical partition plate is provided with a communication through hole through which the mixing chamber communicates with the communication chamber which lies next to the mixing chamber with the vertical partition plate interposed between the chambers.

17. The heat exchanger of claim 16, wherein the connection port is forming in a sidewall of the first header collecting pipe, and faces the vertical partition plate, and the communication through hole of the vertical partition plate is arranged so as not to face the connection port.

18. The heat exchanger of claim 1, wherein the heat exchanger is divided into a main heat exchange region and an auxiliary heat exchange region which each have at least two of the flat tubes, the auxiliary heat exchange region is arranged under the main heat exchange region, the auxiliary heat exchange region is divided into a plurality of auxiliary heat exchange portions, each of which has a plurality of flat tubes and is associated with one of the communication chambers, the flat tubes of the auxiliary heat exchange portions communicate with the communication chambers associated with the respective auxiliary heat exchange portions, the main heat exchange region is divided into a plurality of main heat exchange portions, each of which has a plurality of flat tubes and is associated with one of the auxiliary heat exchange portions, and the flat tubes of the main heat exchange portions communicate, through the second header collecting pipe, with the flat tubes of the auxiliary heat exchange portions associated with the main heat exchange portions.

* * * * *